US010000903B1

(12) United States Patent
Kang

(10) Patent No.: US 10,000,903 B1
(45) Date of Patent: Jun. 19, 2018

(54) CASING ASSEMBLY FOR FORMING CIP RETAINING WALL AND METHOD FOR FORMING CIP RETAINING WALLS USING THE CASING ASSEMBLY

(71) Applicant: HAN JOO ENGINEERING & CONSTRUCTION CO., LTD., Busan (KR)

(72) Inventor: Mun Ki Kang, Busan (KR)

(73) Assignee: HAN JOO ENGINEERING & CONSTRUCTION CO., LTD., Busan (KR)

( * ) Notice: Subject to any disclaimer, the term of this patent is extended or adjusted under 35 U.S.C. 154(b) by 0 days. days.

(21) Appl. No.: 15/815,704

(22) Filed: Nov. 17, 2017

(30) Foreign Application Priority Data

Sep. 12, 2017 (KR) ..... 10-2017-0116601

(51) Int. Cl.

| | |
|---|---|
| ***E02D 5/30*** | (2006.01) |
| ***E02D 5/38*** | (2006.01) |
| ***E02D 29/02*** | (2006.01) |
| ***E02D 5/60*** | (2006.01) |
| *E02D 29/09* | (2006.01) |

(52) U.S. Cl.
CPC ..... *E02D 5/60* (2013.01); *E02D 5/30* (2013.01); *E02D 5/38* (2013.01); *E02D 29/0275* (2013.01); *E02D 29/06* (2013.01)

(58) Field of Classification Search
CPC .... E02D 5/18; E02D 5/30; E02D 5/34; E02D 5/72; E02D 29/02; E02D 29/0275
See application file for complete search history.

(56) References Cited

U.S. PATENT DOCUMENTS 3,851,485 A * 12/1974 Steding ..... E02D 5/34 222/154
5,106,233 A * 4/1992 Breaux ..... B09B 1/008 405/129.8
5,354,149 A * 10/1994 Breaux ..... B09B 1/008 405/129.6

(Continued)

FOREIGN PATENT DOCUMENTS

KR 10-2005-0040045 A 5/2005
KR 765375 * 10/2007 ..... E02D 11/00

(Continued)

*Primary Examiner* — Frederick Lyndon Lagman
(74) *Attorney, Agent, or Firm* — Patent Office of Dr. Chung Park

(57) ABSTRACT

A casing assembly for forming a cast-in-place pile (CIP) retaining wall based on a CIP method. The assembly comprising: a hollow elongate cylinder having a hollow cylindrical inner space defined therein; a H-beam guide received within the hollow cylindrical inner space of the hollow elongate cylinder; and a first H beam having a vertical column form and inserted into the H-beam guide, wherein the H-beam guide includes: a hollow beam-guide frame having a rectangular cross-section such that the first H beam is insertably guided in and along the hollow beam-guide frame; and an outer rounded frame coupled to an outer face of the hollow beam-guide frame, wherein an outer face of the outer rounded frame conforms to an inner face of the hollow elongate cylinder, wherein a top portion of the outer rounded frame is fixed to a top portion of the hollow elongate cylinder via a fastening flange.

18 Claims, 29 Drawing Sheets

(56) References Cited

U.S. PATENT DOCUMENTS

2011/0142550 A1* 6/2011 Lee ..... E02D 5/18
405/285

FOREIGN PATENT DOCUMENTS

| | | | | | |
|---|---|---|---|---|---|
| KR | 858713 | * | 9/2008 | ..... | E02D 17/04 |
| KR | 10-0939535 | B1 | 2/2010 | | |
| KR | 10-1005780 | B1 | 1/2011 | | |
| KR | 10-2011-0097487 | A | 8/2011 | | |
| KR | 10-2015-0104063 | A | 9/2015 | | |

* cited by examiner

【FIG. 1】
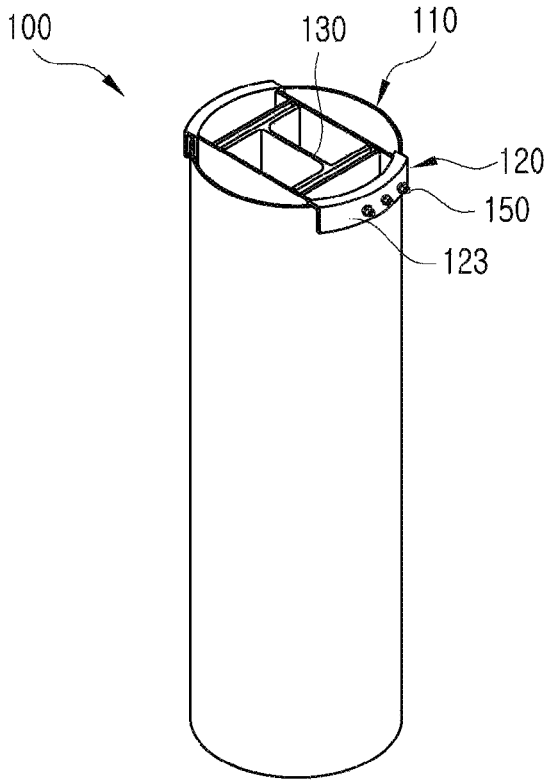

【FIG. 2】
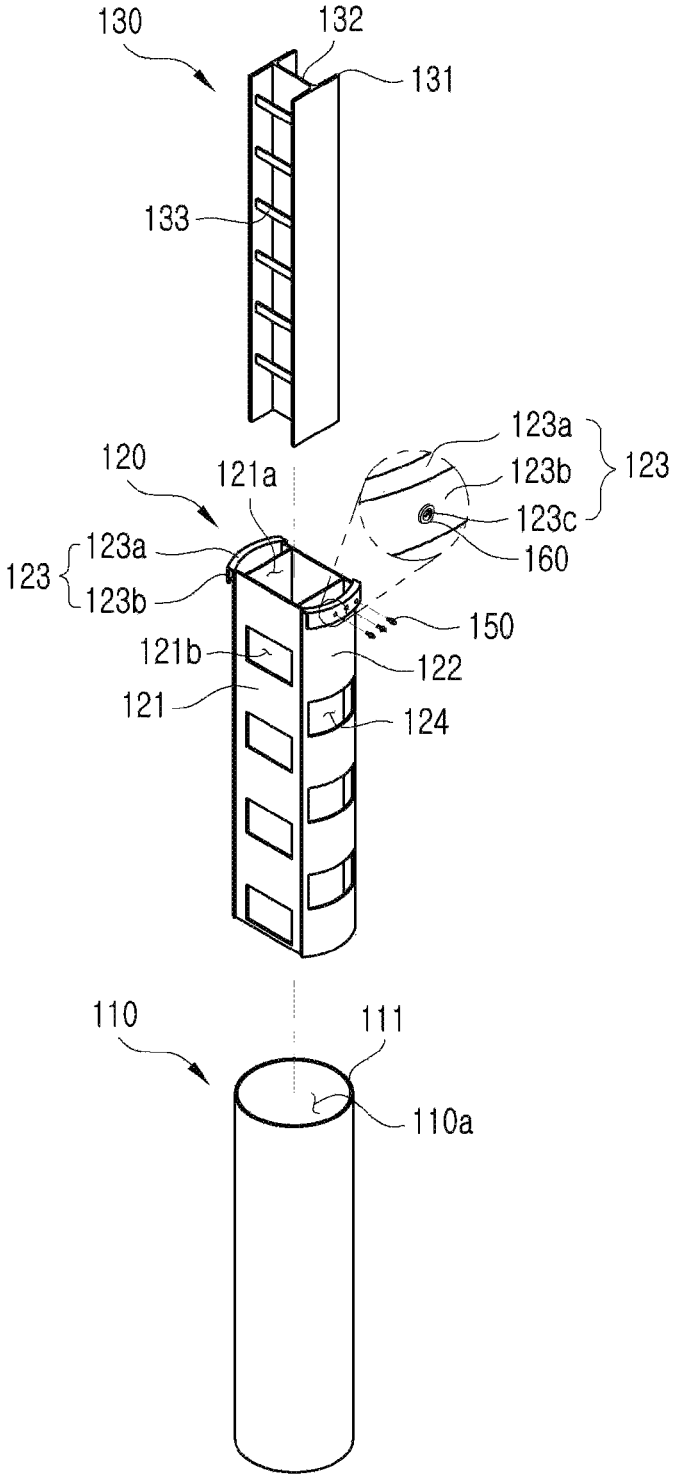

【FIG. 3】
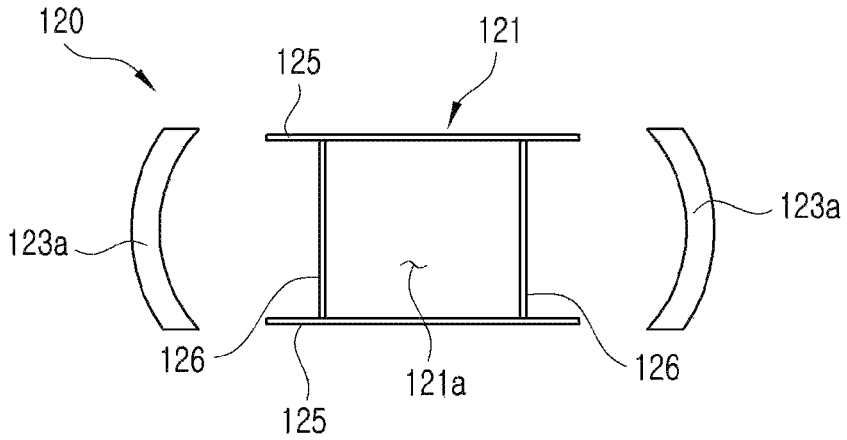
【FIG. 4】
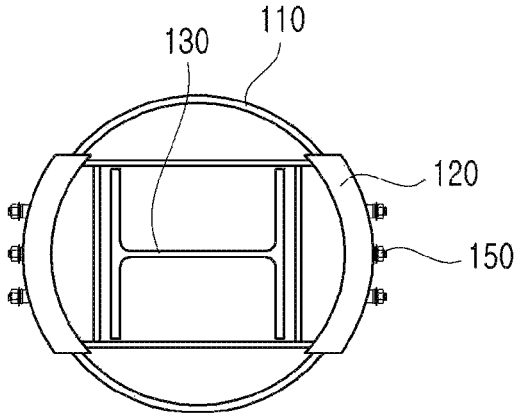

【FIG. 5】
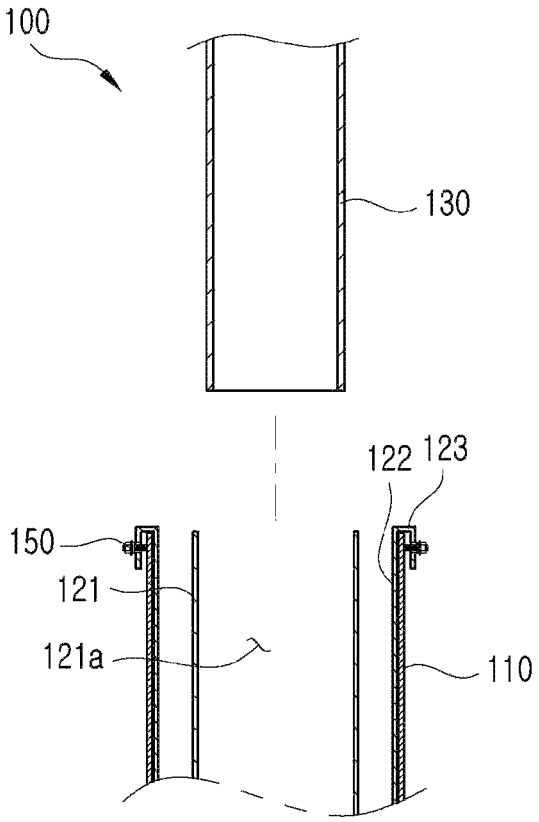

【FIG. 6】
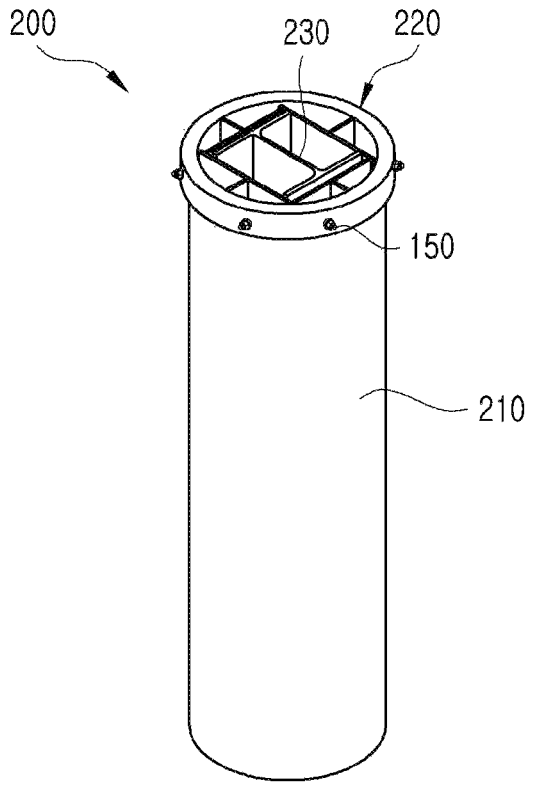

【FIG. 7】
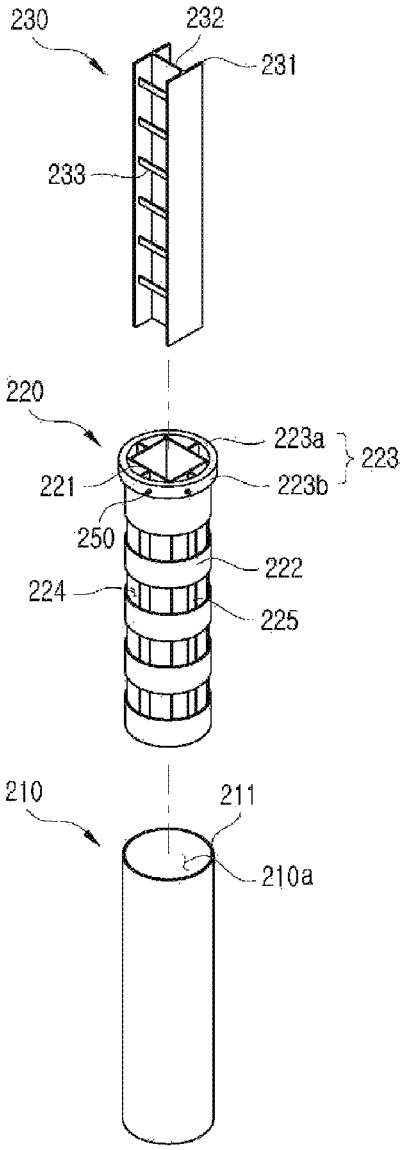

【FIG. 8】
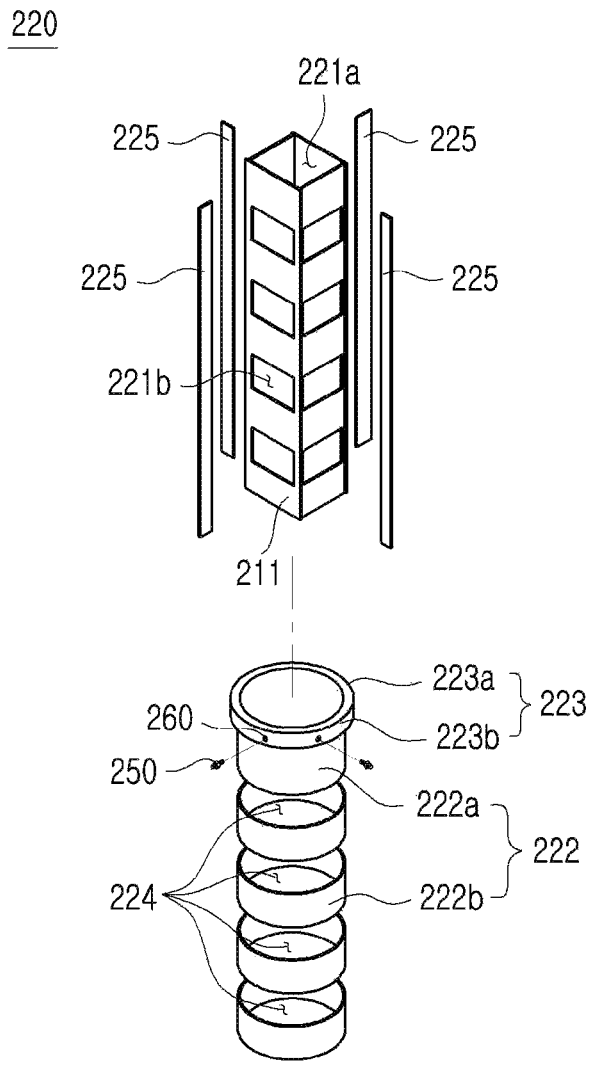
【FIG. 9】
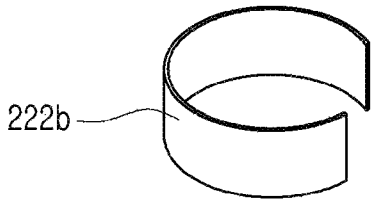

【FIG. 10】
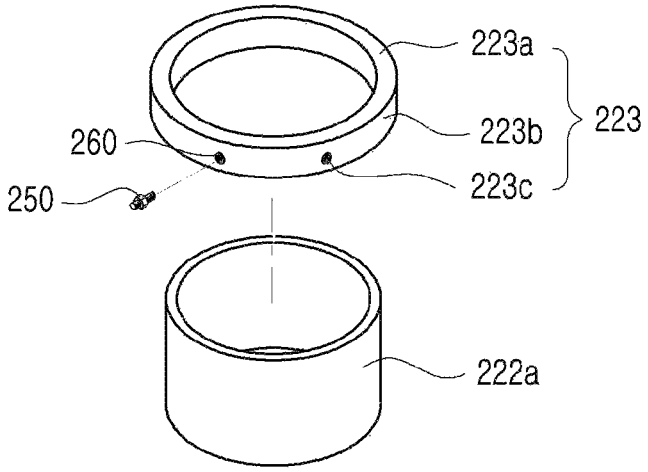
【FIG. 11】
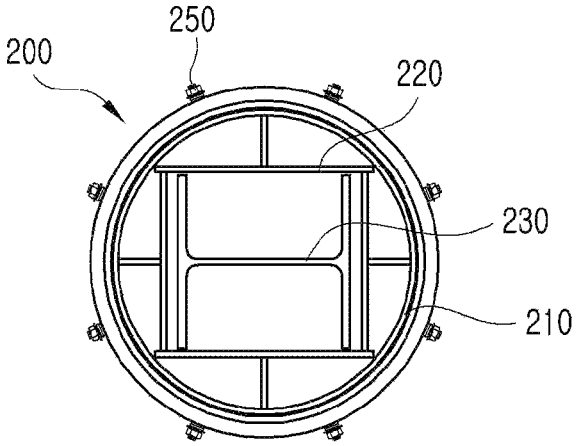

【FIG. 12】
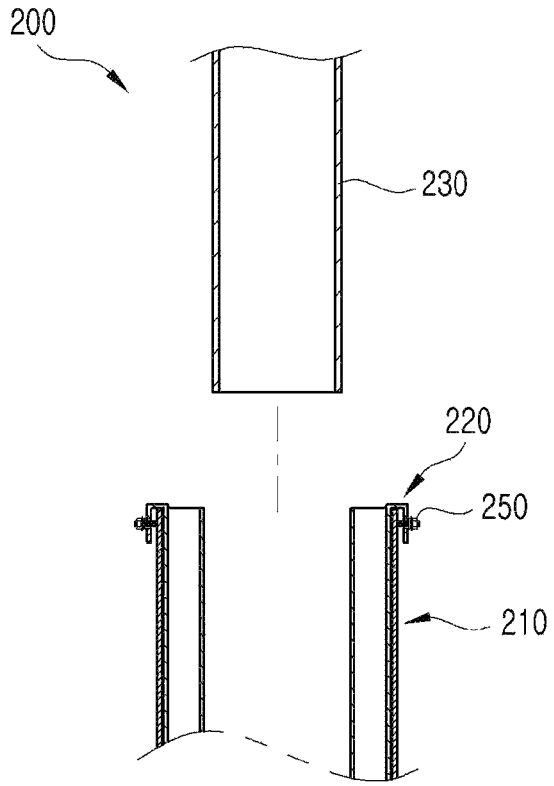

【FIG. 13a】
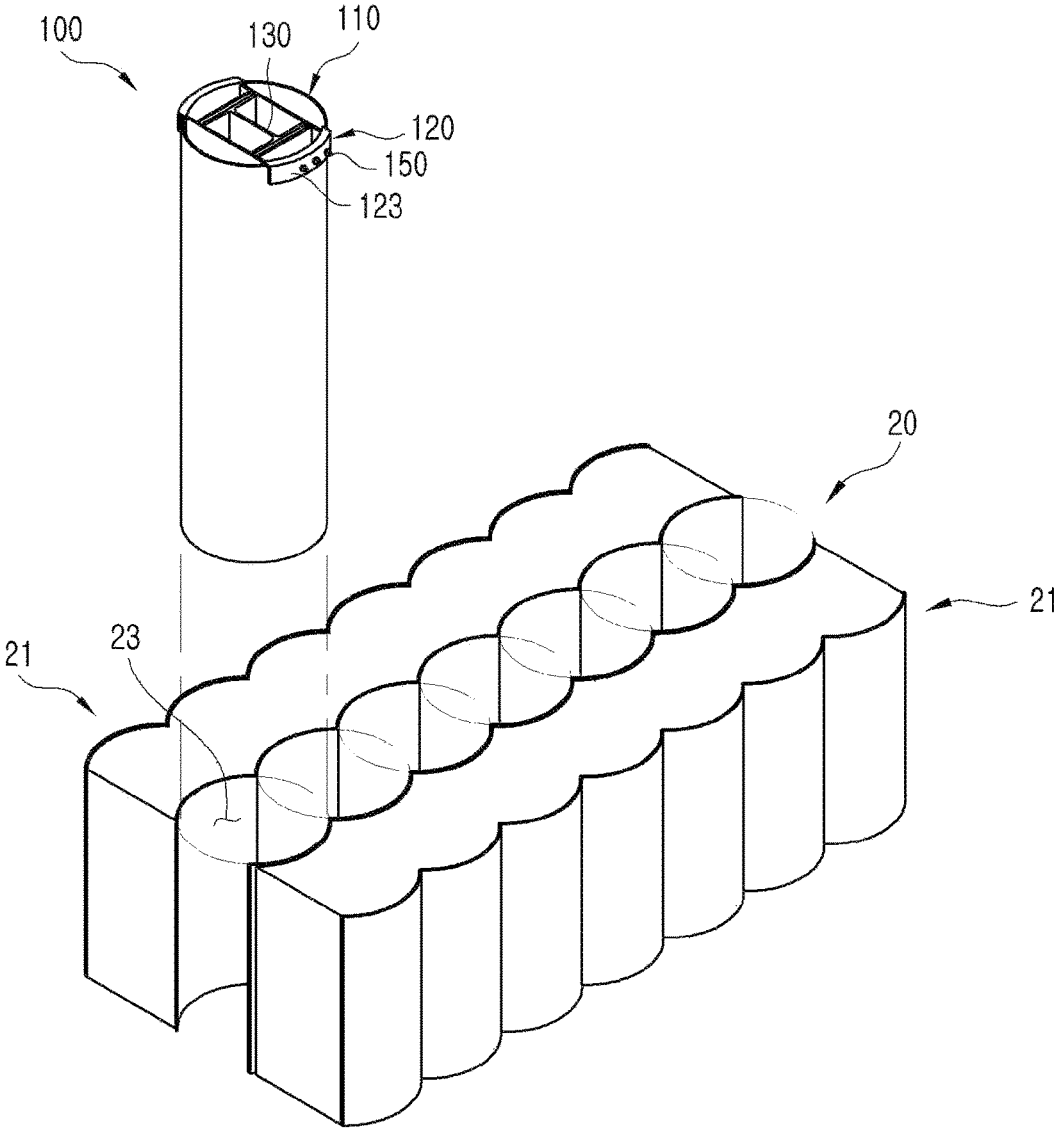

【FIG. 13b】
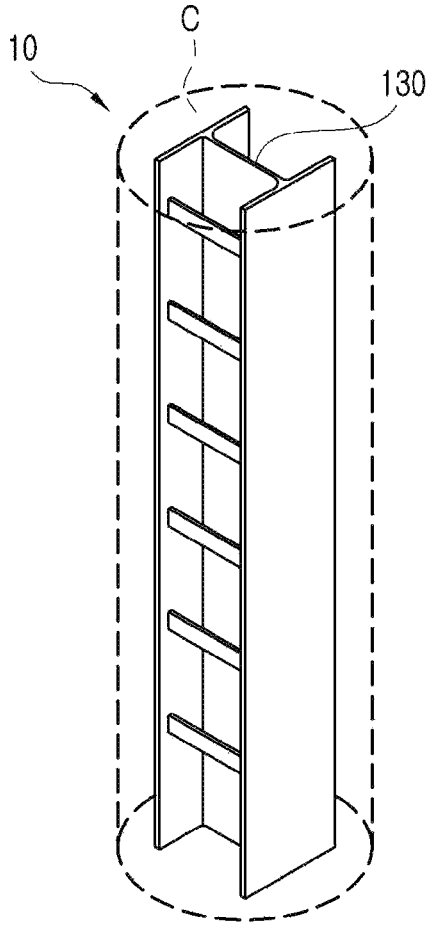
【FIG. 14a】
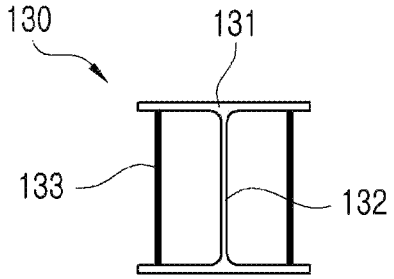

【FIG. 14b】
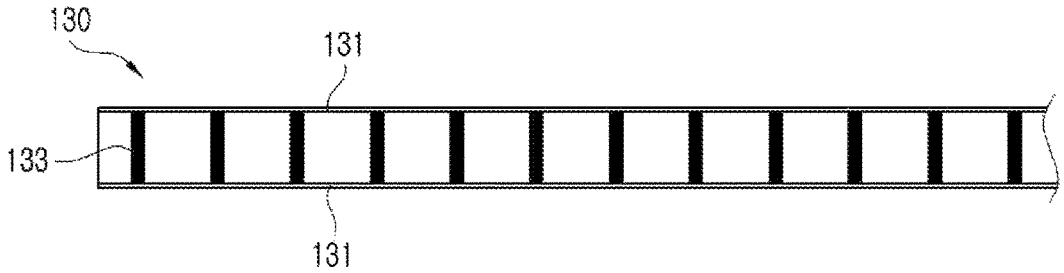
【FIG. 14c】
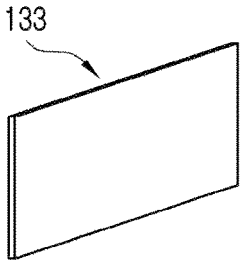
【FIG. 14d】
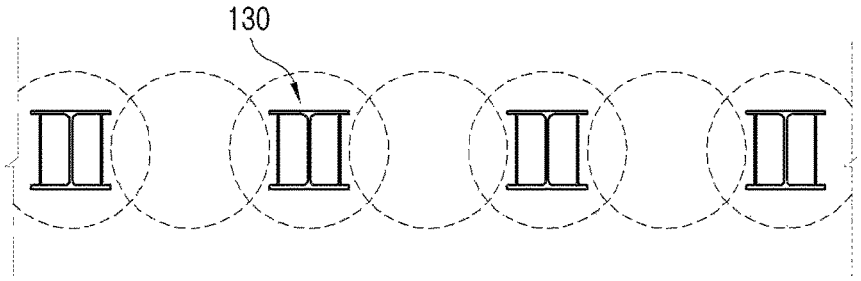

【FIG. 15a】
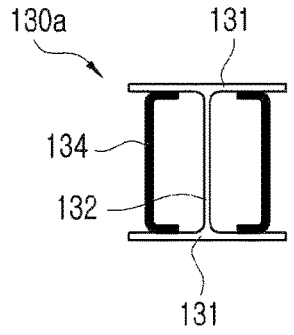
【FIG. 15b】
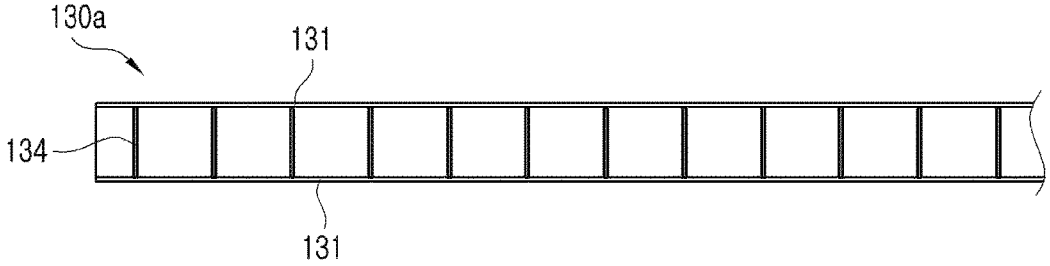
【FIG. 15c】
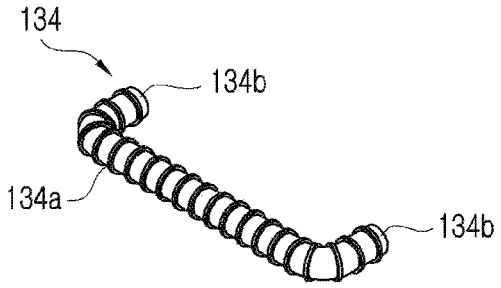
【FIG. 15d】
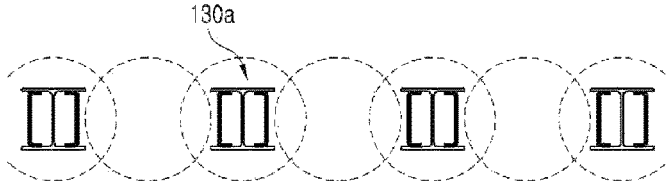

【FIG. 16a】
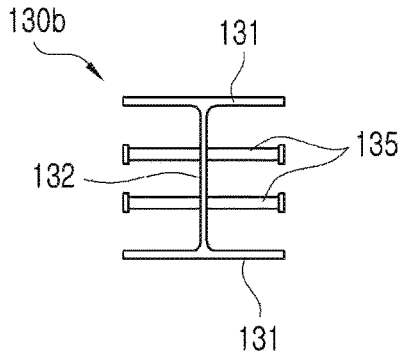
【FIG. 16b】
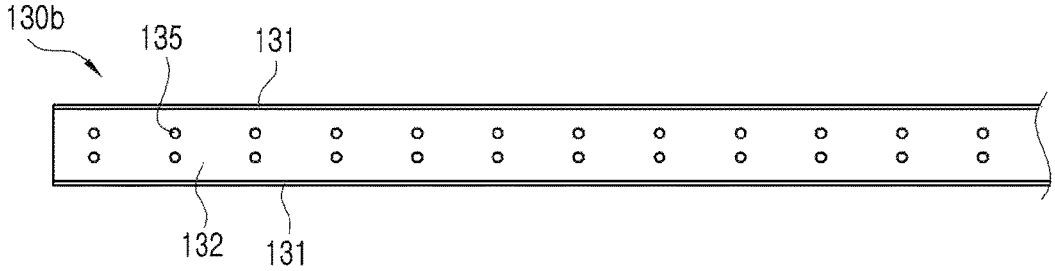
【FIG. 16c】
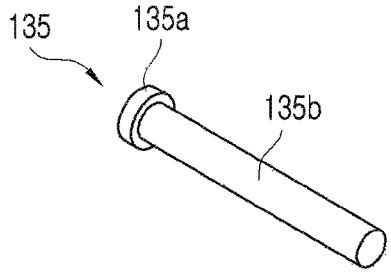

【FIG. 16d】
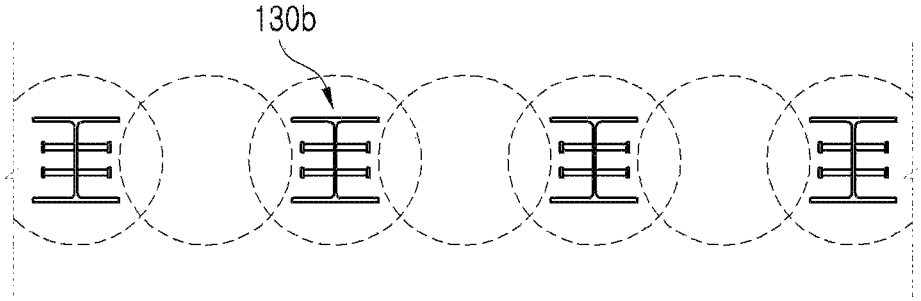
【FIG. 17a】
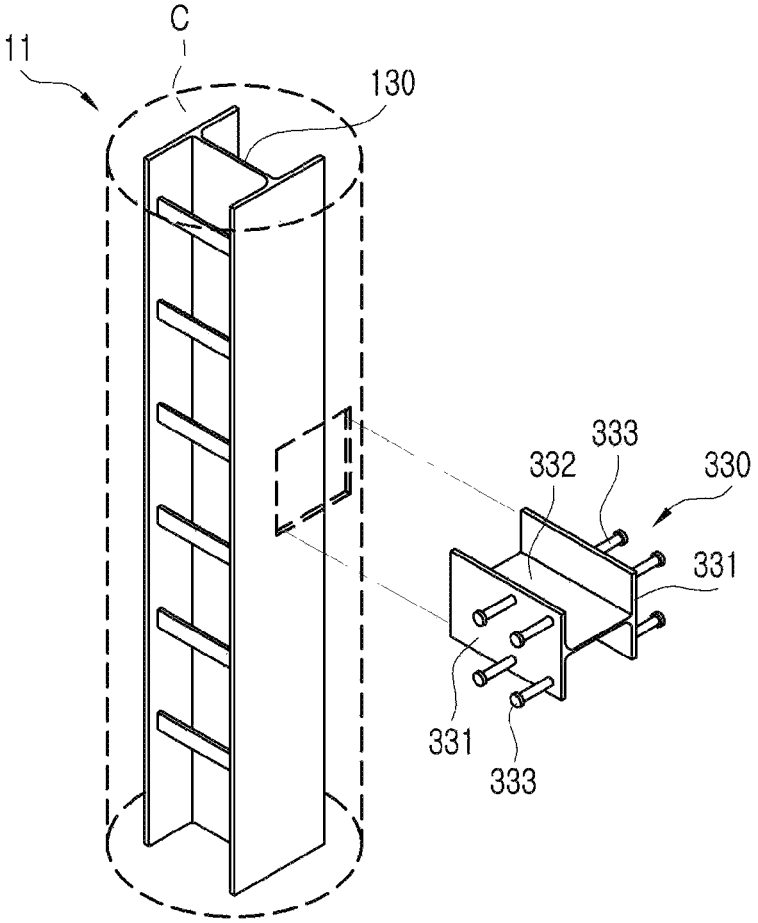

【FIG. 17b】
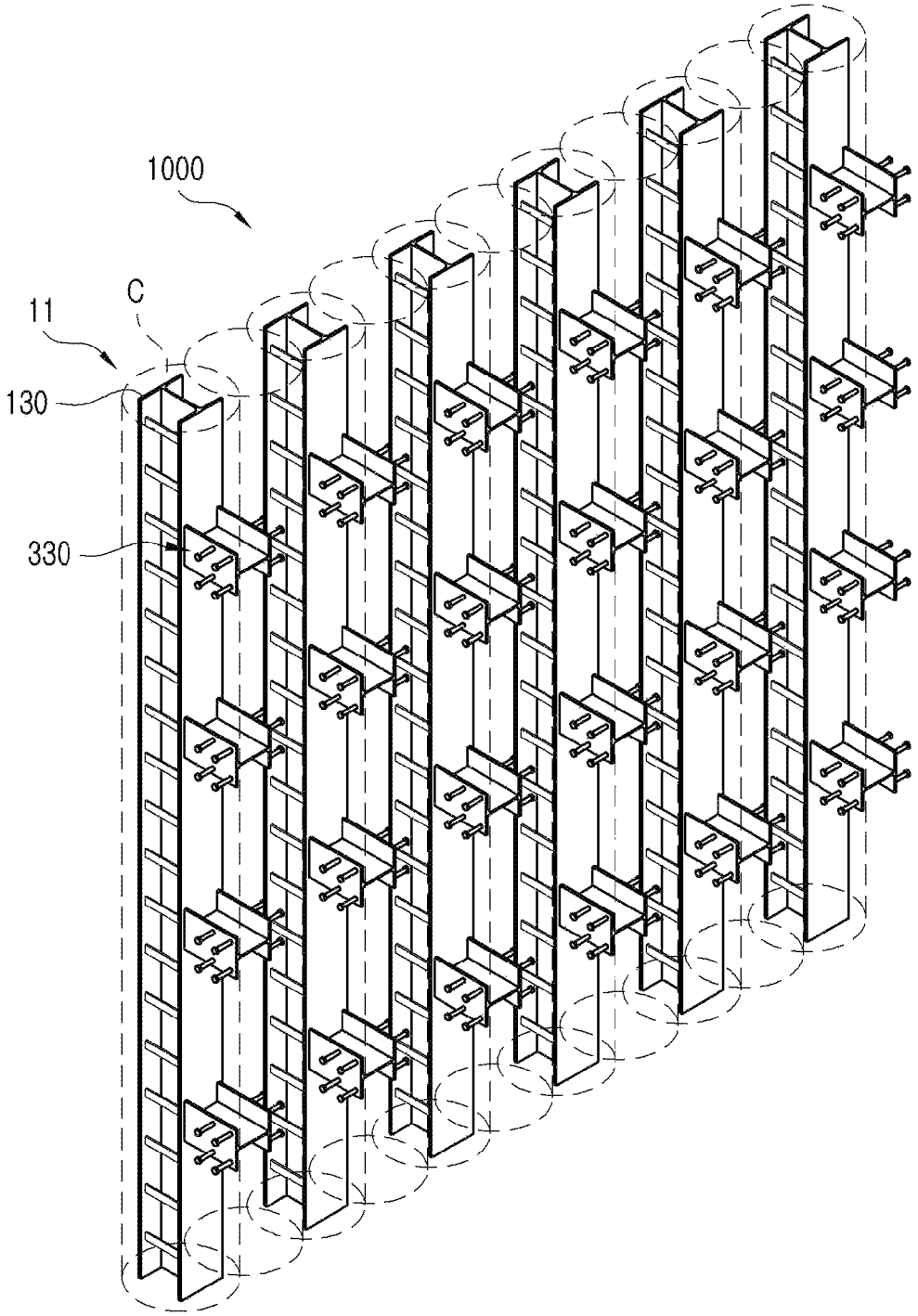

【FIG. 18】
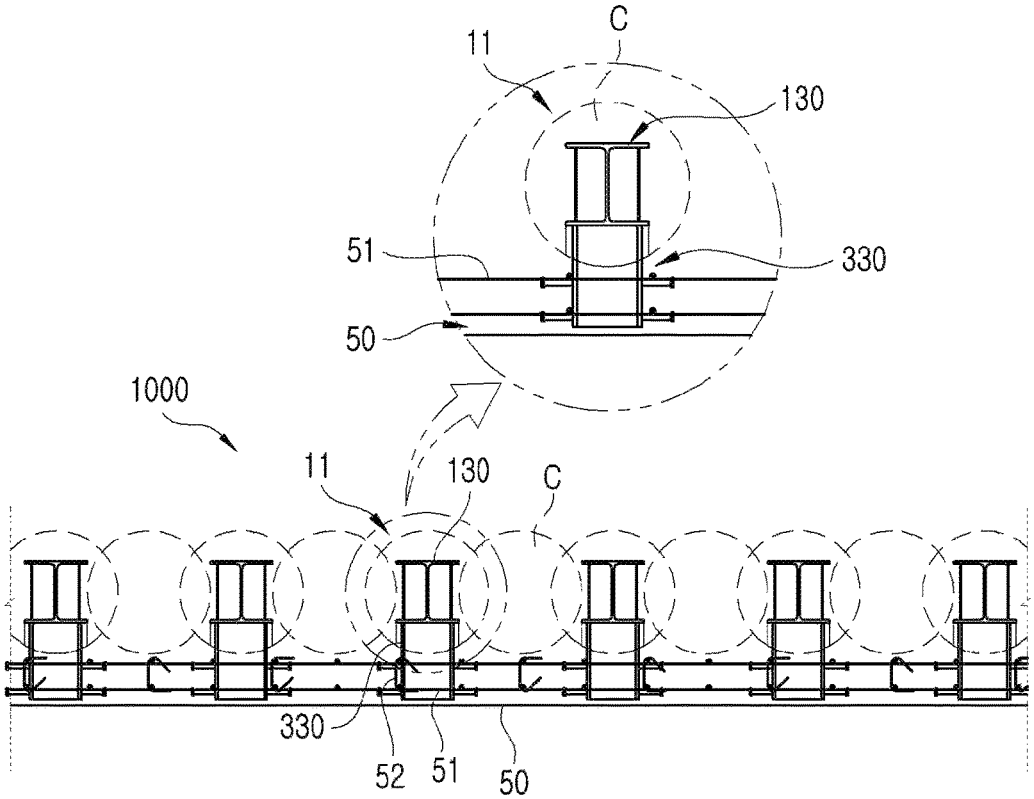

【FIG. 19】
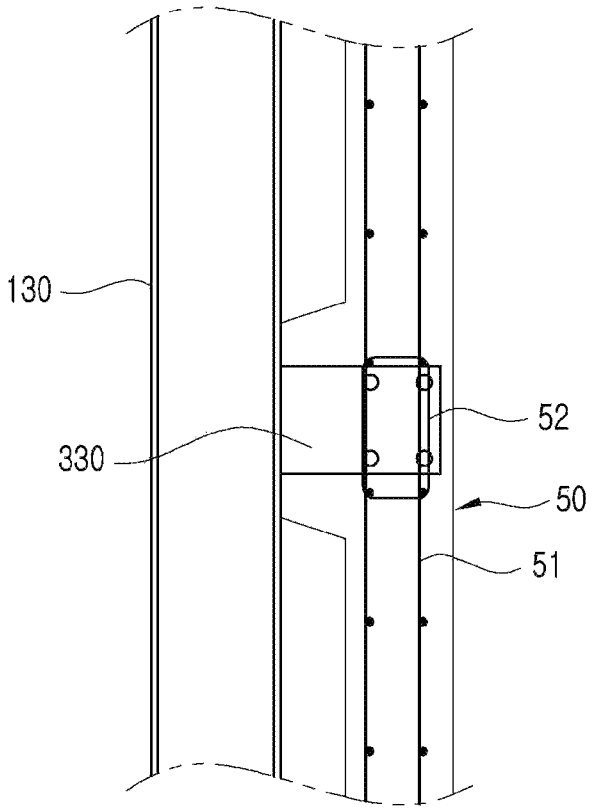

【FIG. 20】
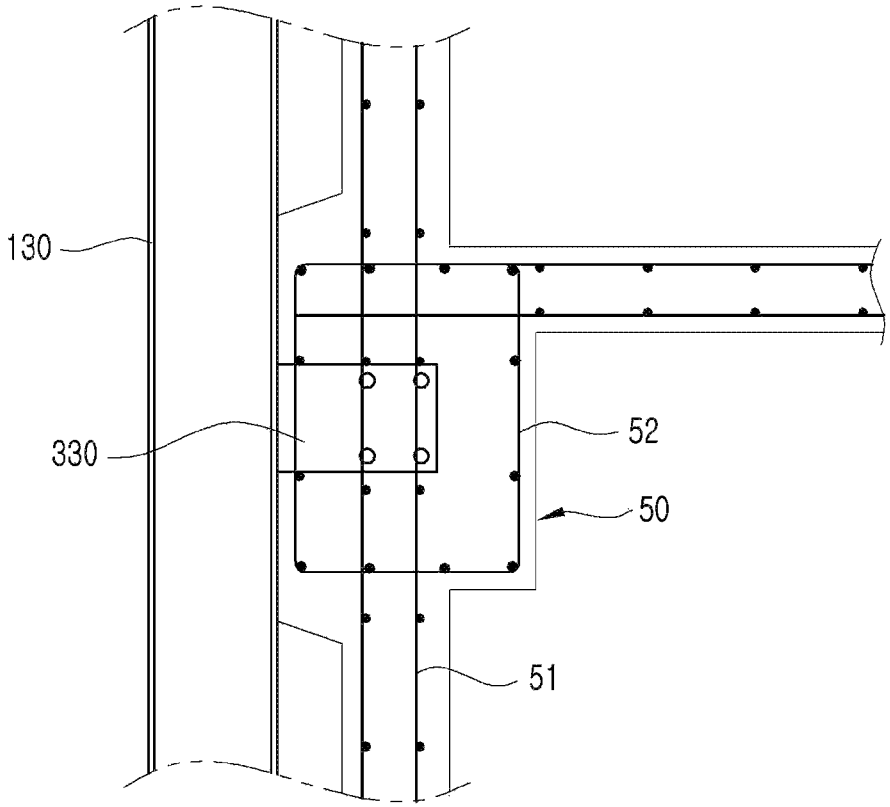

【FIG. 21a】
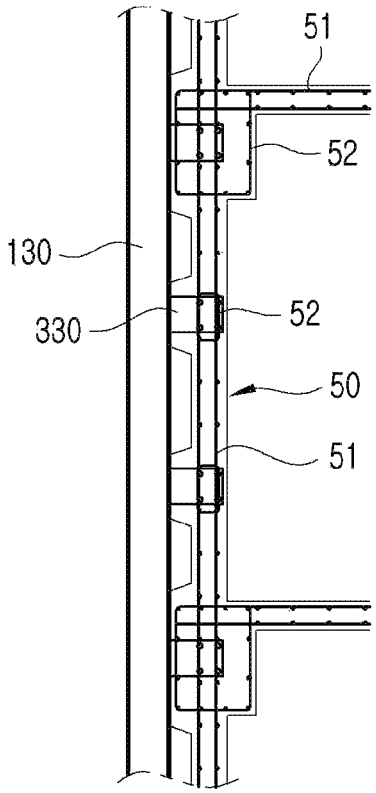

【FIG. 21b】
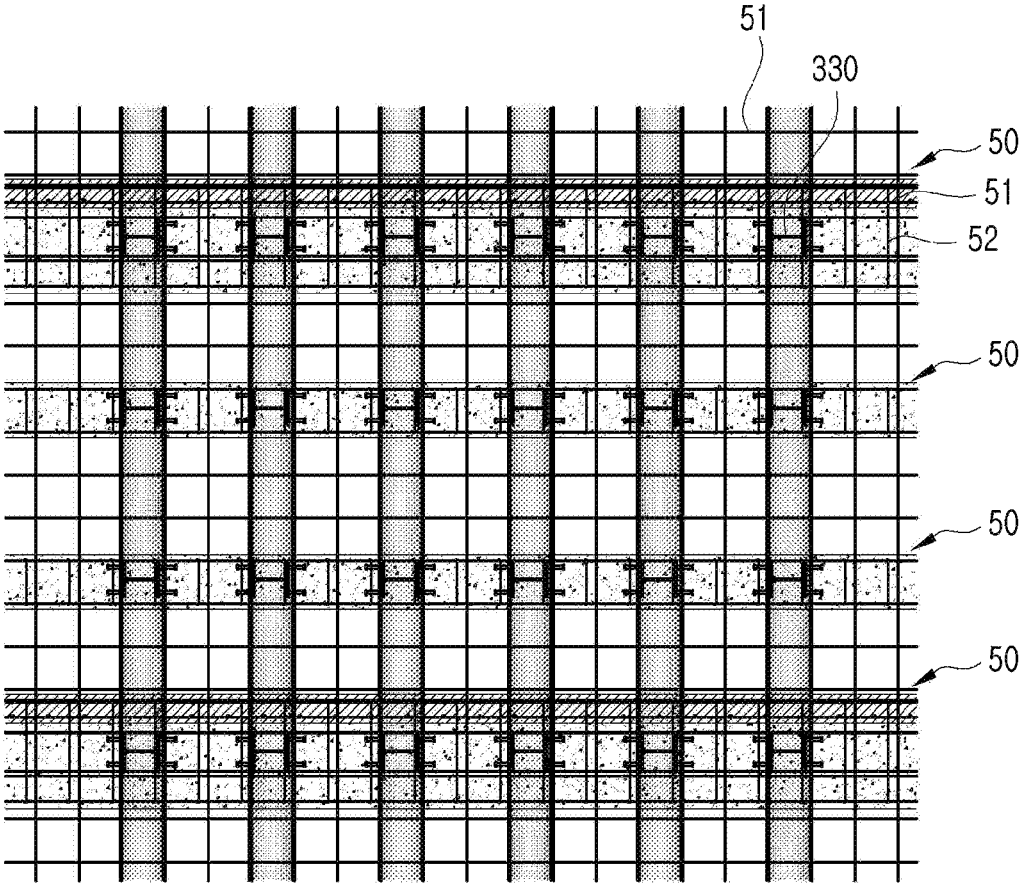

【FIG. 22】
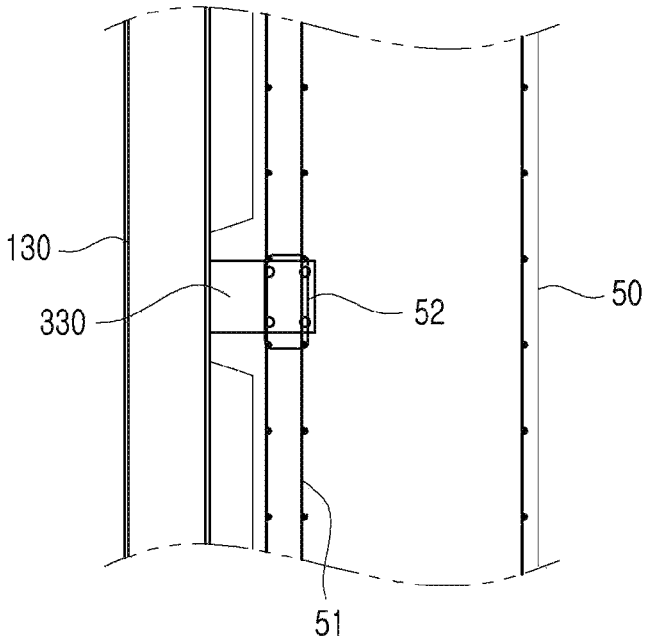

【FIG. 23】
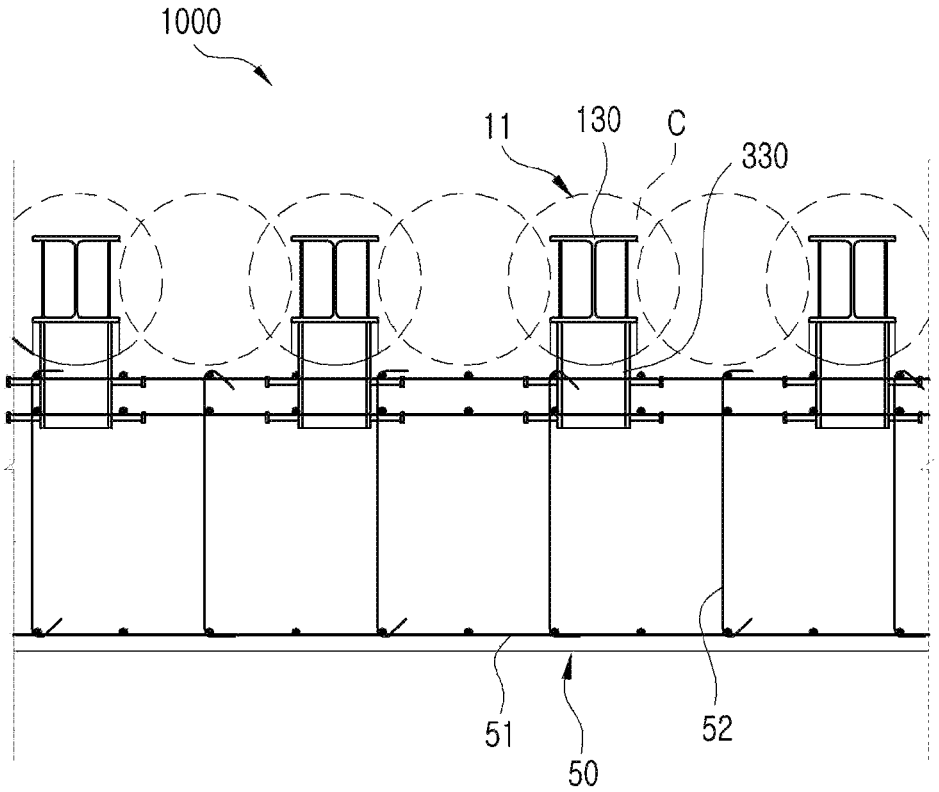

【FIG. 24】
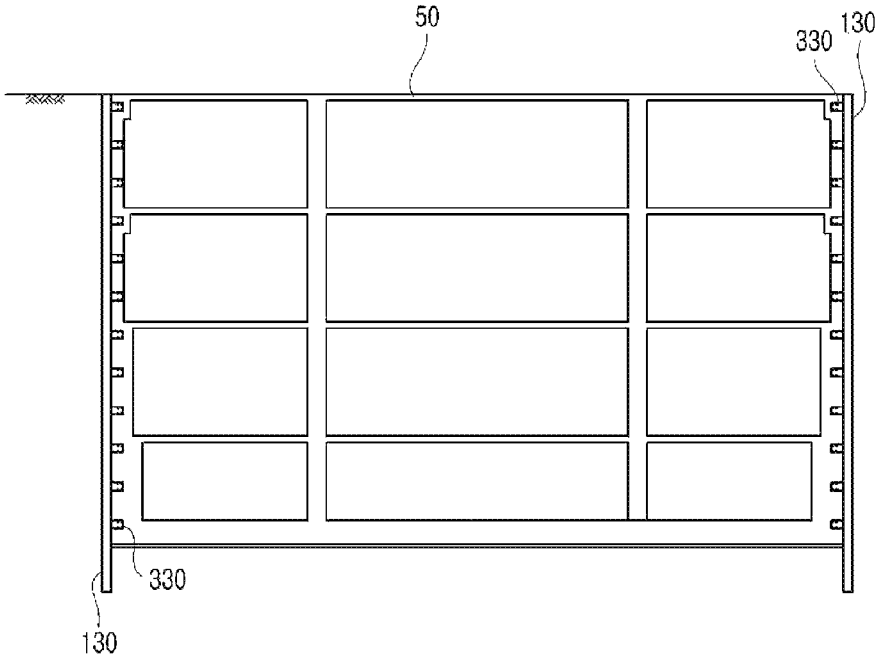
【FIG. 25】
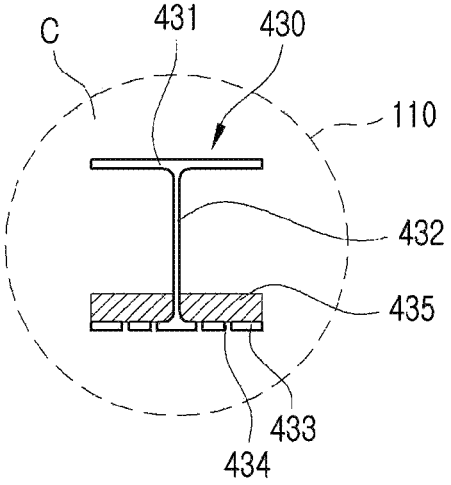

【FIG. 26】
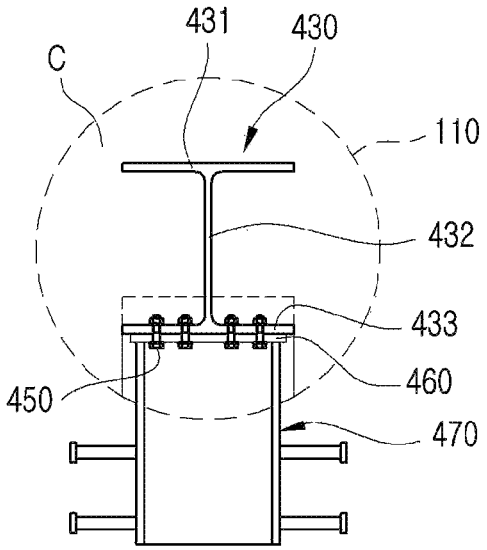
【FIG. 27】
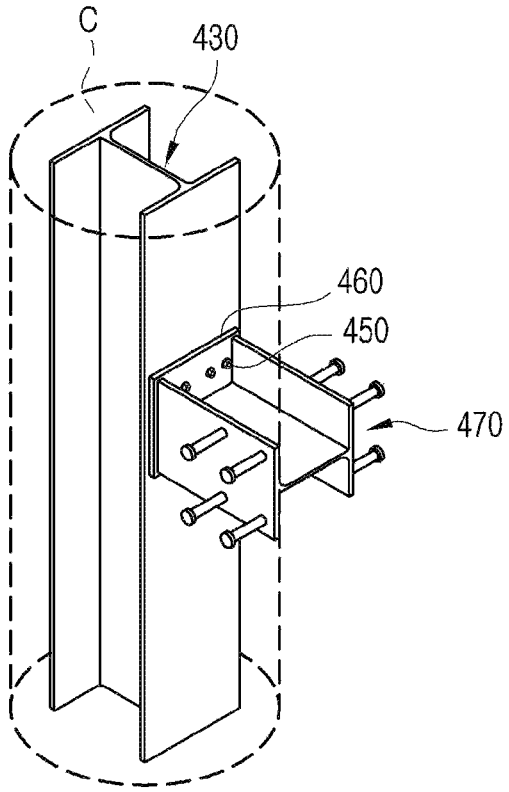

【FIG. 28】
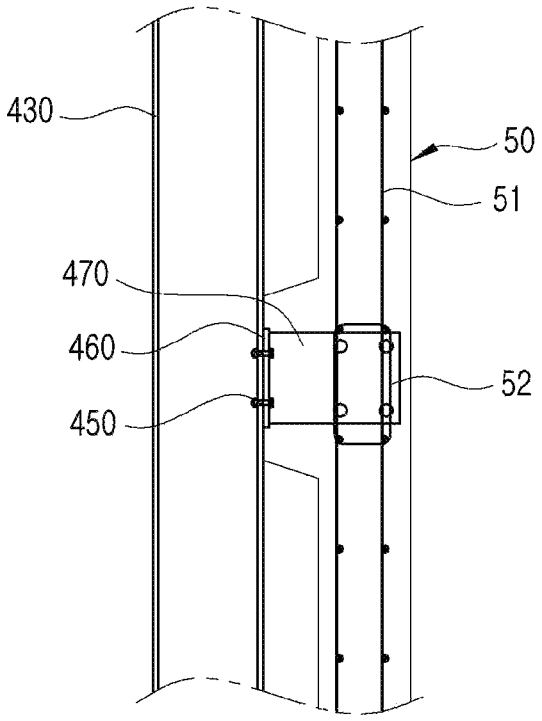

【FIG. 29】
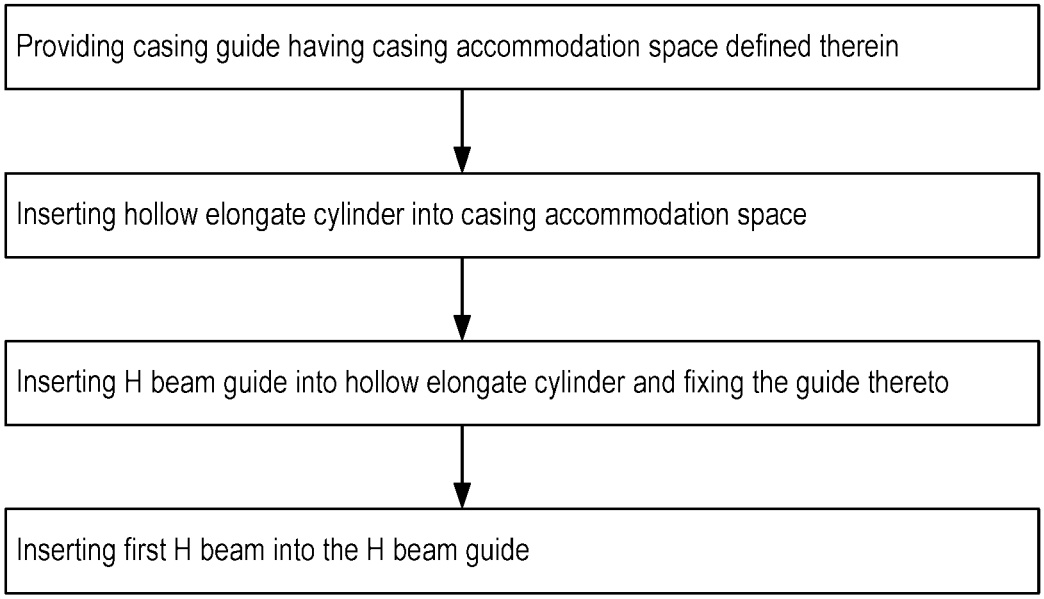

【FIG. 30】
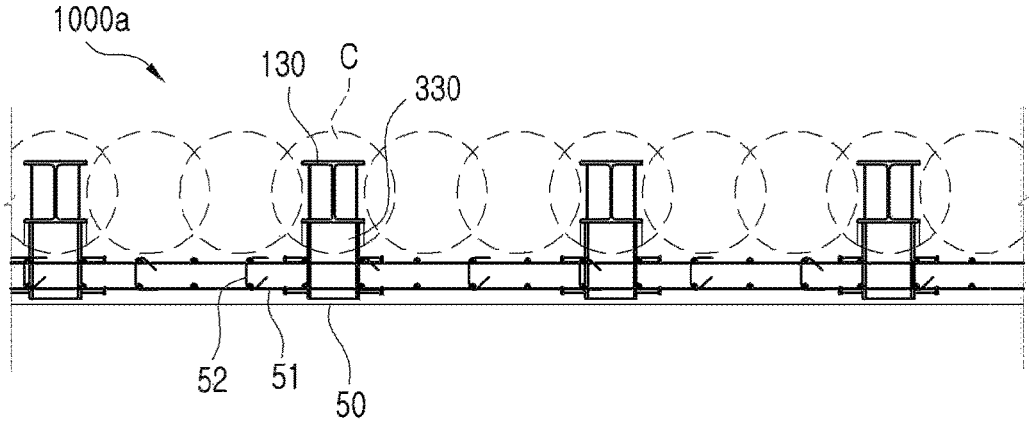
【FIG. 31】
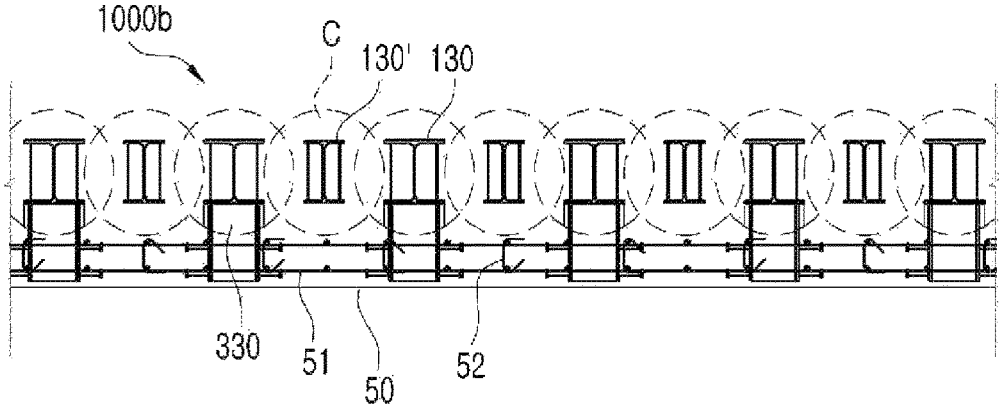

【FIG. 32】
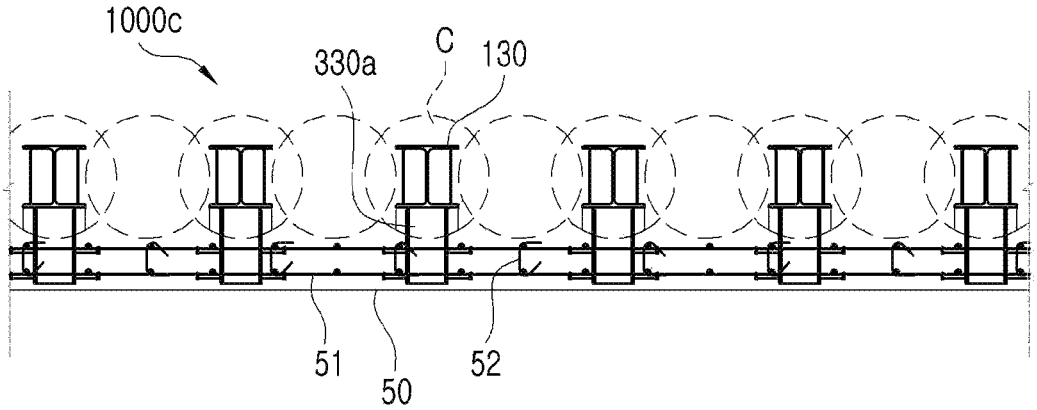

CASING ASSEMBLY FOR FORMING CIP RETAINING WALL AND METHOD FOR FORMING CIP RETAINING WALLS USING THE CASING ASSEMBLY

BACKGROUND

Field of the Present Disclosure

The present invention relates to a casing assembly for forming a cast-in-place pile (CIP) retaining wall and a method for forming CIP retaining walls using the same. More particularly, the present invention relates to a casing assembly for forming a CIP retaining wall which has improved durability and allows efficient construction to effectively prevent soil collapse before underground foundation trench construction when building a building underground layer, and a method for forming CIP retaining walls using the casing assembly.

Discussion of Related Art

A sheathing or retaining wall is a provisional structure installed to prevent the collapse of the wall of excavated holes and the inflow of the soil. The wall requires economical efficiency, safety and construction workability.

One of the methods for forming this sheathing wall is the cast-in-place pile CIP method. In this CIP method, holes are drilled in the ground, a steel casing assembly and an H-shaped beam are inserted into the holes, mortar injection pipes are installed, gravels are inserted into the holes, and filling e.g., cement, mortar, etc. is injected into the holes through the mortar injection pipes, thereby forming cast-in-place piles continuously in the ground.

In the CIP method, the H beam is installed inside the pile, thus, the CIP method is more stable than other construction methods, has noiseless and non-vibration characteristics, and is relatively simple. Therefore, the CIP method is widely used to form the sheathing wall and a water blocking wall.

The underground continuous sheathing walls constructed by the conventional CIP method are disadvantageous in that it is uneconomical because the H beam is disposed after the construction of the underground structure. In addition, the H beam remaining in the ground may be corroded over time due to the decrease of the durability of the concrete due to the salinization, the alkali aggregate reaction, the neutralization, or due to the influence of the ambient air to the H beam itself. This may cause environmental pollution such as water pollution.

In the conventional CIP method, it is possible to construct a retaining wall even under a narrow working space and to form the wall having a greater rigidity at a small cross sectional size thereof. However, the pile may be constructed so that the pile does not maintain its verticality, and thus the interval between the piles becomes large, and the aggregate separation may occur due to the flow rate of the groundwater. If the soil condition is poor, the anchoring portion of the pile may not be constructed normally. For these reasons, the continuous retaining walls are poorly installed, and, thus, measures are necessary to reinforce the joint between the walls. In the presence of groundwater, separate water blocking methods such as water blocking LW grouting, SGR grouting, cement grouting, etc. are required on the backside of the wall. This takes a lot of time and cost.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

An object of the present invention is to provide a casing assembly for forming a CIP retaining wall, which is configured to allow efficient earth retaining wall formation even in a narrow work space, and a method for forming CIP retaining walls using the casing assembly.

Another object of the present invention is to provide a casing assembly for forming a CIP retaining wall, which is constructed to allow eliminating of a separate water blocking method and thereby realizing construction cost reduction and construction time reduction, and a method for forming CIP retaining walls using the casing assembly.

Further, still another object of the present invention is to provide a casing assembly for forming a CIP retaining wall, which is constructed to have a separate second H beam on a side of a first H beam included in the aggregate constituting the CIP retaining wall, thereby to facilitate arrangement of steel bars and strengthen the underground retaining wall, and a method for forming CIP retaining walls using the casing assembly.

In one aspect of the present invention, there is provided a casing assembly for forming a CIP retaining wall based on a CIP (cast-in-place pile) method, the assembly comprising: a hollow elongate cylinder having a hollow cylindrical inner space defined therein; a H-beam guide received within the hollow cylindrical inner space of the hollow elongate cylinder; and a first H beam having a vertical column form and inserted into the H-beam guide, wherein the H-beam guide includes: a hollow beam-guide frame having a rectangular cross-section such that the first H beam is insertably guided in and along the hollow beam-guide frame; and an outer rounded frame coupled to an outer face of the hollow beam-guide frame, wherein an outer face of the outer rounded frame conforms to an inner face of the hollow elongate cylinder, wherein a top portion of the outer rounded frame is fixed to a top portion of the hollow elongate cylinder via a fastening flange.

In one embodiment of the casing assembly, the fastening flange includes: a vertical portion formed in a shape rounded to conform to an outer face of the hollow elongate cylinder; and a horizontal portion extending perpendicularly to the vertical portion from a top of the vertical portion and contacting a top portion of the hollow elongate cylinder, wherein the horizontal portion is integral with a top portion of the H-beam guide, wherein fixing holes horizontally penetrate the vertical portion, wherein fasteners pass through the fixing holes, thereby to fix the vertical portion to the hollow elongate cylinder.

In one embodiment of the casing assembly, the hollow beam-guide frame has one or more first lateral openings defined therein, wherein the first lateral openings are spaced apart from each other in a longitudinal direction of the hollow beam-guide frame, wherein the outer rounded frame has one or more second lateral openings defined therein, wherein the second lateral openings are spaced apart from each other in a longitudinal direction of the outer rounded frame, wherein the first lateral openings are arranged to be alternated with the second lateral openings.

In one embodiment of the casing assembly, the first H beam includes: a pair of first column plates facing each other and spaced from each other and extending parallel to each other; a first column bridge connecting the pair of first column plates at centers thereof, wherein the bridge extends perpendicularly to the pair of first column plates; and horizontal reinforcement connectors spaced from the first column bridge, each reinforcement connector connecting distal ends of the pair of the first column plates.

In one embodiment of the casing assembly, the casing assembly includes a second H beam installed on a side face of the first H beam, wherein the second H beam includes: a pair of second column plates facing each other and spaced apart from each other and extending parallel to each other; a second horizontal bridge connecting inner faces of the pair of the second column plates with each other and extending perpendicularly to the second column plates; and one or more stud bolts disposed on an outer face of each of the second column plates.

In one embodiment of the casing assembly, the hollow beam-guide frame includes: a pair of main plates facing each other and spaced from each other and extending parallel to each other; and a pair of connection plates perpendicularly connected to inner faces of the pair of the main plates and spaced apart from each other in parallel, wherein both ends of each of the main plates extends outward beyond each of the connection plates and are connected to ends of a pair of the outer rounded frames respectively.

In one embodiment of the casing assembly, the H-beam guide includes: the hollow beam-guide frame having a rectangular hexahedral shape defining a space therein for accommodating the first H beams; the outer rounded frame formed to surround an outer face of the hollow beam-guide frame and having a cylindrical shape having a hollow portion therein; and reinforcement ribs, each rib connecting an outer face of the hollow beam-guide frame and an inner face of the outer rounded frame.

In one embodiment of the casing assembly, the hollow beam-guide frame has one or more first lateral openings defined therein, wherein the first lateral openings are spaced apart from each other in a longitudinal direction of the hollow beam-guide frame, wherein the outer rounded frame includes a plurality of outer rounded sub-frames spaced apart from one another vertically, wherein an uppermost outer rounded sub-frame is coupled to the fastening flange, wherein the plurality of outer rounded sub-frames define second lateral openings between adjacent outer rounded sub-frames.

In one embodiment of the casing assembly, the fastening flange includes: a donut-shaped horizontal portion extending perpendicularly to the uppermost outer rounded sub-frame and being in contact with a top portion of the hollow elongate cylinder; and a vertical portion extending vertically downwardly from the horizontal portion, wherein the horizontal portion is integrally coupled to the top portion of the hollow beam-guide frame, wherein fixing holes horizontally penetrate the vertical portion, wherein fasteners pass through the fixing holes, thereby to fix the vertical portion to the hollow elongate cylinder.

In one embodiment of the casing assembly, each of the horizontal reinforcement connectors includes: an elongate extension extending parallel to and spaced apart from the first column bridge; and bent portions bent perpendicularly from both ends of the elongate extension and extending parallel to and being in contact with inner faces of the pair of the first column plates respectively.

In one aspect of the present disclosure, there is provided a method for a retaining wall complex using a casing assembly guide for guiding the casing assembly as defined above, wherein the retaining wall complex includes a CIP retaining wall fabricated using the casing assembly as defined above, wherein the method comprises: providing the casing assembly guide, wherein the casing guide comprises: a first guide-body having first inner and outer vertical faces and first top and bottom horizontal faces extending in a length-direction thereof, wherein the first inner face is configured in a shape thereof such that a plurality of first concave-rounded vertically-extended portions are arranged in the length-direction and are connected to one another; and a second guide-body having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face to define a casing accommodation space therebetween; and inserting the casing assembly into the casing accommodation space, wherein inserting the casing assembly into the casing accommodation space includes: inserting the hollow elongate cylinder into the casing accommodation space; inserting the H-beam guide into the hollow elongate cylinder; fixing the H-beam guide to the hollow elongate cylinder via the fastening flange; and inserting the first H beam into the H-beam guide.

In one embodiment of the method, the method further includes: after inserting the first H beam into the H-beam guide, pulling upwardly the H-beam guide out of the cylinder; injecting concrete into the hollow elongate cylinder; and removing the hollow elongate cylinder from the concrete, thereby forming a CIP retaining wall.

In one embodiment of the method, the method further includes: after forming the CIP retaining wall, removing a side portion of the CIP retaining wall to expose a side portion of the first H beam; and coupling a second H beam to the exposed side portion of the first H beam via welding or fasteners, wherein the second H beam includes stud blots.

In one embodiment of the method, inserting the casing assembly into the casing accommodation space includes: inserting a plurality of casing assemblies to be spaced from each other, wherein CIP retaining walls having the first H beam embedded therein are alternated with retaining walls free of the first H beam.

In one embodiment of the method, the method further includes: providing the first H beam, wherein the first H beam includes: a pair of first column plates facing each other and spaced from each other and parallel to each other; a first column bridge connecting the pair of first column plates at centers thereof; and horizontal reinforcement connectors spaced from the first column bridge, each connector connecting the distal ends of the pair of the first column plates, wherein providing the first H beam includes providing main first H beams, each min H beam having a first length of the first column plate, and auxiliary first H beams, wherein each auxiliary H beam has the first column plate having a length less than the first length, wherein inserting the first H beam into the H-beam guide includes: inserting the main first H beams into a plurality of first casing accommodation spaces receiving a plurality of hollow elongate cylinders respectively, wherein the method further comprises inserting auxiliary first H beams into a plurality of second casing accommodation spaces free of the hollow elongate cylinder, wherein the plurality of first casing accommodation spaces are alternated with the plurality of second casing accommodation spaces.

In one embodiment of the method, the method further includes providing the second H beam, wherein the second H beam comprises: a pair of the second column plates facing each other and extending parallel to each other and spaced from each other; a second horizontal bridge extending between inner faces of the pair of second column plates and extending perpendicular to the inner faces; and one or more stud bolts provided on an outer surface of the second column plate, wherein coupling the second H beam to the exposed side portion of the first H beam includes coupling the second H beam to the exposed side portion of the first H beam such that each of the second column plates of the second H beam is positioned to correspond to a position of the horizontal reinforcement connector, or such that each of the second column plates of the second H beam is positioned further inwardly than the position of the horizontal reinforcement connector.

In one embodiment of the method, the method further includes: defining one or more bolt holes at a portion of the first H beam where the second H beam is connected thereto; and attaching one or more provisional spacer member to the first H beam to be adjacent to the bolt holes, wherein inserting the first H beam includes inserting the first H beam having the provisional spacer member attached thereto, wherein the method includes: removing the provisional spacer member from the first H beam to define an empty space; and inserting a reinforcing plate into the empty space, wherein coupling the second H beam to the exposed side portion of the first H beam includes forming fixing bolt holes in the reinforcing plate and passing bolts through the bolt holes to fix the second beam to the first beam.

In one embodiment of the method, the retaining wall complex includes an outer wall coupled to the CIP retaining wall, wherein the method further comprises: connecting steel bars to the stud blots of the second H beam; and additionally injecting concrete such that the steel bars, the CIP retaining wall and the stud bolts are integrated with each other via the additionally injected concrete to form the outer wall coupled to the CIP retaining wall.

The present invention has following advantageous effects to which the present invention is not limited:

First, the present casing assembly for forming the CIP retaining wall and the present method for forming CIP retaining walls using the casing assembly allows efficient earth retaining wall formation even in a narrow work space.

Second, the present casing assembly for forming the CIP retaining wall and the present method for forming CIP retaining walls using the casing assembly allows eliminating of a separate water blocking method and thereby realizing construction cost reduction and construction time reduction.

Third, the present casing assembly for forming the CIP retaining wall and the present method for forming CIP retaining walls using the casing assembly facilitates arrangement of steel bars and strengthens the underground retaining wall.

BRIEF DISCRETION OF THE DRAWINGS

FIG. 1 is a perspective view of a casing assembly for forming a CIP retaining wall, in accordance with an embodiment of the present invention.

FIG. 2 is an exploded perspective view of the casing assembly of FIG. 1.

FIG. 3 is a top view of an H-beam guide of FIG. 2.

FIG. 4 is a top view of the casing assembly of FIG. 1.

FIG. 5 is a view schematically showing insertion of a first H beam.

FIG. 6 is a perspective view of a casing assembly for forming a CIP retaining wall, in accordance with another embodiment of the present invention.

FIG. 7 is an exploded perspective view of the casing assembly of FIG. 6.

FIG. 8 is an exploded perspective view of an H-beam guide of FIG. 7.

FIG. 9 is a view schematically showing an outer rounded frame of FIG. 8.

FIG. 10 is an exploded perspective view of a topmost outer rounded sub-frame and a fastening flange coupled thereto in FIG. 8.

FIG. 11 is a top view of the casing assembly of FIG. 6.

FIG. 12 is a view schematically showing the insertion of a first H beam in FIG. 6.

FIG. 13A is a schematic view of a casing assembly guide for guiding a casing assembly for forming a CIP retaining wall according to an embodiment of the present invention.

FIG. 13B is a schematic view of a CIP retaining wall fabricated using the casing assembly to form a CIP retaining wall, in accordance with an embodiment of the present invention, with FIG. 13*b*.

FIGS. 14A to 14D are a top view and a side view of the first H beam, a reinforcing member thereof, and a CIP retaining wall formed using the first H beam according to an embodiment of the present invention, respectively.

FIGS. 15A to 15D are a top view and a side view of the first H beam, a reinforcing member thereof, and a CIP retaining wall formed using the first H beam according to another embodiment of the present invention, respectively.

FIGS. 16A to 16D are a top view and a side view of the first H beam, a reinforcing member thereof, and a CIP retaining wall formed using the first H beam according to still another embodiment of the present invention, respectively.

FIG. 17A is a schematic view of a CIP retaining wall manufactured using a casing assembly to form a CIP retaining wall, according to another embodiment of the present invention.

FIG. 17B is a view schematically showing CIP retaining walls formed continuously in connection with FIG. 17A.

FIGS. 18 to 24 are schematic illustrations of securing successive CIP retaining walls to an outer retaining wall using steel bars to form an underground retaining wall with beams and slabs.

FIG. 25 is a view showing a first H beam according to another embodiment of the present invention.

FIG. 26 is a view showing a connection structure of a first H beam and a second H beam in FIG. 25.

FIG. 27 illustrates a CIP retaining wall having first and second H beams according to an embodiment of the present invention.

FIG. 28 is a view showing a state in which an underground retaining outer retaining wall is formed by connecting CIP retaining walls in conjunction with FIG. 27.

FIG. 29 is a flowchart illustrating an underground outer retaining wall construction method based on a CIP method according to a preferred embodiment of the present invention.

FIG. 30 to FIG. 32 are schematic top views of an underground outer retaining wall formed by the construction method according to FIG. 29.

For simplicity and clarity of illustration, elements in the figures are not necessarily drawn to scale. The same reference numbers in different figures denote the same or similar elements, and as such perform similar functionality.

DETAILED DESCRIPTIONS

Examples of various embodiments are illustrated and described further below. It will be understood that the description herein is not intended to limit the claims to the specific embodiments described. On the contrary, it is intended to cover plate alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated go degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

FIG. 1 is a perspective view of a casing assembly for forming a CIP retaining wall, in accordance with an embodiment of the present invention. FIG. 2 is an exploded perspective view of the casing assembly of FIG. 1. FIG. 3 is a top view of a H-beam guide of FIG. 2. FIG. 4 is a top view of the casing assembly of FIG. 1. FIG. 5 is a view schematically showing insertion of a first H beam.

A casing assembly 100 for forming a CIP retaining wall according to an embodiment of the present invention is used to form a CIP retaining wall constituting an underground outer retaining wall by using a CIP method. The casing assembly 100 for forming the CIP retaining wall may include a hollow elongate cylinder 110 having a hollow cylindrical inner space 110*a* defined therein; a H-beam guide 120 received within the hollow cylindrical inner space 110*a* of the hollow elongate cylinder 110; and a first H beam 130 having a vertical column form and inserted into the H-beam guide 120.

The H-beam guide 120 includes a hollow beam-guide frame 121 having a rectangular cross-section such that the first H beam 130 is insertably guided in and along the hollow beam-guide frame 121; and an outer rounded frame 122 coupled to an outer face of the hollow beam-guide frame 121. The outer face of the outer rounded frame 122 conforms to the inner face of the hollow elongate cylinder 110. The top portion of the outer rounded frame 122 is fixed to the top portion of the hollow elongate cylinder 110 via a fastening flange 123.

The casing assembly 100 for forming a CIP retaining wall according to an embodiment of the present invention is used to produce a concrete pile in order to prevent soil collapse prior to the underground foundation trench construction. The concrete pile having a small diameter is produced by inserting the first H beam 130 into the H-beam guide 120 and filling the concrete into the H-beam guide 120. These concrete piles may be continuously arranged to form a continuous array of CIP type retaining walls. Further, after constructing the underground foundation trench inside the array of the CIP retaining walls as produced using the casing assembly too for forming the CIP retaining wall according to the present embodiment, the array of the CIP retaining walls may be coupled to an underground outer retaining wall via steel bars.

The casing assembly too for forming the CIP retaining wall comprises the hollow elongate cylinder 110, the H-beam guide 120 accommodated in the hollow elongate cylinder 110 and defining a vertical elongate internal space of the hexahedron therein, and a first H beam 130 inserted into the hexahedral space and oriented by the H-beam guide 120. The H-beam guide 120 is fixed to the hollow elongate cylinder 110. The first H beam 130 may be easily aligned to be positioned at the center of the hollow elongate cylinder 110 by being guided along the internal space defined by the H-beam guide 120.

The H-beam guide 120 is inserted into the hollow elongate cylinder 110 and may be stably fixed to the cylinder 110 by the fastening flange 123. The fastening flange 123 includes a vertical portion 123*b* formed in a shape rounded to correspond to an outer surface of the hollow elongate cylinder 110; and a horizontal portion 123*a* extending perpendicularly to the vertical portion 123*b* from the top of the vertical portion 123*b* and contacting the top of the hollow elongate cylinder 110. In this connection, the horizontal portion 123*a* is formed as a single body with the outer rounded frame 122, wherein the horizontal portion 123*a* is coupled to the outer rounded frame 122 at the top portion thereof. Fixing holes 123*c* horizontally penetrate the vertical portion 123*b*. Separate fasteners 150 pass through the fixing holes 123*c* defined in the vertical portion 123*b*, thereby to fix the vertical portion 123*b* to the hollow elongate cylinder 110. In one example, a nut 160 having an internal thread is formed integrally with the inner periphery of the fixing holes 123*c*, while the separate fasteners 150 may be, for example, bolts passing through the fixing holes 123*c*. In this way, the top portion of the outer rounded frame 122 is fixed to the top portion of the hollow elongate cylinder 110 via the fastening flange 123.

The spacing between the outer surface of the top portion of the outer rounded frame 122 and the inner face of the vertical portion 123*b* of the fastening flange 123 may correspond to the thickness of the hollow elongate cylinder 110 such that the top portion of the hollow elongate cylinder 110 is tightly inserted between the outer surface of the top portion of the outer rounded frame 122 and the inner face of the vertical portion 123*b* of the fastening flange 123. The H-beam guide 120 is inserted into the hollow elongate cylinder 110. In this connection, the top portion of the hollow elongate cylinder 110 is inserted between the outer surface of the top portion of the outer rounded frame 122 and the vertical portion 123*b* of the fastening flange 123 and is fixed thereto. Accordingly, the H-beam guide 120 may be stably fixed to the hollow elongate cylinder 110 in the hollow elongate cylinder 110.

The H-beam guide 120 includes the hollow beam-guide frame 121 defining a rectangular opening 121*a* therein, and the outer rounded frame 122 coupled to at least a portion of an outer face of the hollow beam-guide frame 121 and being rounded, and in face-contact with the inner face of the hollow elongate cylinder 110.

The hollow beam-guide frame 121 may include a pair of main plates 125 facing each other and spaced from each other and parallel to each other, and a pair of connection plates 126 perpendicularly connected to the inner faces of the pair of the main plates 125 and spaced apart from each other in parallel. Both ends of each of the main plates 125 may extend outward beyond each of the connection plates 126 and may be connected to ends of the pair of the outer rounded frames 122 respectively. For example, the outer rounded frame 122 may be connected to both ends of the pair of main plates 125 so as to be spaced from the connection plates 126.

The rectangular opening 121*a* defined by the hollow beam-guide frame 121 conforms to the outer contour of the first H beam 130. The first H beam 130 may be removably inserted into the opening 121*a* and may be aligned with the hollow elongate cylinder 110 in a concentric manner.

The hollow beam-guide frame 121 and the outer rounded frame 122 each define one or more first and second lateral openings 121*b*, 124. The first and second lateral openings 121*b* and 124 are spaced apart from each other in the longitudinal direction of the hollow beam-guide frame 121 and the outer rounded frame 122. The hollow beam-guide frame 121 may define one or more first lateral openings 121*b*. The outer rounded frame 122 may define one or more second lateral openings 124. The first lateral openings 121*b* defined in the hollow beam-guide frame 121 may be arranged to be alternated with the second openings 124 defined in the outer rounded frame 122 in the longitudinal direction thereof, that is, in a vertical direction.

For example, a plurality of the first openings 121*b* may be spaced apart at regular intervals along the longitudinal direction of the hollow beam-guide frame 121, while the plurality of second openings 124 may be spaced apart and arranged at regular intervals along the longitudinal direction of the outer rounded frame 122. The first and second openings 121*b* and 124 are formed in each of the hollow beam-guide frame 121 and the outer rounded frame 122, thereby reducing the weight of the hollow beam-guide frame 121 and the outer rounded frame 122. Further, the first and second openings 121*b* and 124 are alternately arranged with each other. For example, the second opening 124 may be positioned between adjacent first openings 121*b*. In this way, the durability of the hollow beam-guide frame 121 and the outer rounded frame 122 may be improved by aligning the first and second openings 121*b* and 124 so as to be staggered with each other.

The first H beam 130 is arranged concentrically with the hollow elongate cylinder 110, such that, when the CIP retaining wall, which is manufactured by casting the concrete into the hollow elongate cylinder 110, the first H beam 130 are arranged concentrically with the CIP retaining wall. This H beam may function to reinforce the strength of the retaining wall. The first H beam 130 includes a pair of first column plates 131 facing each other and spaced from each other and parallel to each other, a first column bridge 132 connecting the pair of first column plates 131 at centers thereof, and horizontal reinforcement connectors 133 spaced from the first column bridge 132, each connector connecting the distal ends of the pair of the first column plates 131.

The first column plates 131 may be supported by the first column bridge 132 coupled thereto. The horizontal reinforcement connectors 133 reinforce the pair of the first column plates 131 by connecting the pair of the first column plates 131 to improve the strength of the first H beams 130. For example, each of the horizontal reinforcement connectors 133 may be implemented in various forms, or may be realized as a plate-like reinforced steel plate or a structure with one side opened form. The horizontal reinforcement connectors 133 may be coupled to the inner face of the pair of first column plates 131 by using one or more of reinforcing bars and stud bolts or by welding.

FIG. 6 is a perspective view of a casing assembly for forming a CIP retaining wall, in accordance with another embodiment of the present invention. FIG. 7 is an exploded perspective view of the casing assembly of FIG. 6. FIG. 8 is an exploded perspective view of an H-beam guide of FIG. 7. FIG. 9 is a view schematically showing an outer rounded frame of FIG. 8. FIG. 10 is an exploded perspective view of a topmost outer rounded sub-frame and a fastening flange coupled thereto in FIG. 8. FIG. 11 is a top view of the casing assembly of FIG. 6. FIG. 12 is a view schematically showing the insertion of a first H beam in FIG. 6.

Referring to FIG. 6 to FIG. 12, the casing assembly 200 for forming the CIP retaining wall according to the present embodiment may include a hollow elongate cylinder 210 formed in a cylindrical shape; a H-beam guide 220 inserted into the hollow elongate cylinder 210, the H-beam guide 220 having a hollow beam-guide frame 221 and an outer rounded frame 222, wherein the H-beam guide 220 includes a fastening flange 223 coupled to the hollow elongate cylinder 210; and a first H beam 230 having a pile shape inserted into the H-beam guide 220.

The H-beam guide 220 may be configured to guide the first H beam 230 so that the first H beam 230 is aligned concentrically with the hollow elongate cylinder 210. After the first H beam 230 is inserted into the hollow elongate cylinder 210 and the H-beam guide 220 is withdrawn out of the cylinder 210, concrete may be injected into the hollow elongate cylinder 210. After the hollow elongate cylinder 210 is removed from the concrete, a CIP retaining wall made of a cylindrical concrete having the first H beam 230 defined therein may be produced.

The H-beam guide 220 includes a hollow beam-guide frame 221 defining therein a space into which the first H beam 230 is inserted; and an outer rounded frame 222 having an outer face in face-contact with the inner face of the hollow elongate cylinder 210, wherein the outer rounded frame 222 surrounds the outer face of the hollow beam-guide frame 221.

The H-beam guide 220 includes a hollow beam-guide frame 221 having a rectangular hexahedral shape defining a space 221*a* therein for accommodating the first H beams 230; an outer rounded frame 222 formed to surround the outer surface of the hollow beam-guide frame 221 and having a cylindrical shape having a hollow portion; and reinforcement ribs 225 connecting the outer face of the hollow beam-guide frame 221 and the inner face of the outer rounded frame 222. In each of the hollow beam-guide frame 221 and the outer rounded frame 222, the first and second openings 221*b* and 224 may be respectively formed to reduce the weight of the H-beam guide 220.

The second opening 224 may be defined between the plurality of outer rounded frames 222 so that the plurality of outer rounded frames 222 may be longitudinally spaced apart from one another. The uppermost outer rounded frame 222 may be coupled to the fastening flange 223.

Annular structures defining the outer rounded frame 222 may include the uppermost annular structure 222*a* coupled to the fastening flange 223, and remaining annular structures 222*b* arranged below the uppermost annular structure 222*a* in the longitudinal direction, i.e., vertically and spaced apart from each other. The remaining annular structures 222*b* may include the plurality of remaining annular structures 222*b*. In this connection. The plurality of remaining annular structures 222*b* may be spaced apart from each other with the second opening 224 being defined therebetween. For example, the uppermost annular structure 222*a* and the remaining annular structures 222*b* constituting the outer rounded frame 222 may be partially connected to each other or spaced apart from each other. Further, each of the uppermost annular structure 222*a* and the remaining annular structures 222*b* may be formed in a circular plate shape, and may be connected to the edge of the hollow beam-guide frame 221 and the end portions of the reinforcement ribs 225.

The reinforcement rib 225 may be disposed at the center of the outer surface of the hollow beam-guide frame 221. For example, the reinforcement rib 225 is connected to the outer surface of the hollow beam-guide frame 221. The reinforcement rib 225 may be provided in a space defined between the outer rounded frame 222 provided in a rounded shape corresponding to the inner face of the hollow elongate cylinder 210 and the hollow beam-guide frame 221. Thus, the reinforcement rib 225 may allow the strength of the H-beam guide 220 to be reinforced to improve durability.

The fastening flange 223 includes a donut-shaped horizontal portion 223*a* extending perpendicularly to the top portion of the outer rounded frame 222, e.g., the uppermost annular structure 222*a*, that is, horizontally, and being generally in contact with the top portion of the hollow elongate cylinder 210. A vertical portion 223*b* of the fastening flange 223 extends vertically downwardly from the horizontal portion 223*a* and is spaced from and faces the outer surface of the hollow elongate cylinder 210. The horizontal portion 223*a* is integrally coupled to the top portion of the hollow beam-guide frame 221, i.e., a monolith with the top portion of the hollow beam-guide frame 221. One or more fixing holes 223*c* horizontally penetrate the vertical portion 223*b* and are spaced apart from each other along the horizontal circumferential direction at regular intervals.

The horizontal portion 223*a* of the fastening flange 223 may be in entire contact with the top portion of the hollow elongate cylinder 210 and thus may be supported by the top end of the hollow elongate cylinder 210. Further, a nut 260 may be integrally formed into each of the fixing holes 223*c* defined in the vertical portion 223*b* to be spaced apart at regular intervals. The nut 260 may be fastened with a separate fastener 250, such as a bolt, to fasten the vertical portion of the fastening flange 223 and the top face portion of the hollow elongate cylinder 210 together. The first H beam 230 is inserted into the H-beam guide 220 so that the first H beam 230 may be stably fixed to the hollow elongate cylinder 210 in a concentric manner. The first H beam 230 is arranged concentrically with the hollow elongate cylinder 110, such that, when the CIP retaining wall, which is manufactured by casting the concrete into the hollow elongate cylinder 110, the first H beam 230 are arranged concentrically with the CIP retaining wall. This H beam may function to reinforce the strength of the retaining wall. The first H beam 230 includes a pair of first column plates 231 facing each other and spaced from each other and parallel to each other, a first column bridge 232 connecting the pair of first column plates 231 at centers thereof, and horizontal reinforcement connectors 233 spaced from the first column bridge 232, each connector connecting the distal ends of the pair of the first column plates 231. The first column plates 231 may be supported by the first column bridge 232 coupled thereto. The horizontal reinforcement connectors 233 reinforce the pair of the first column plates 231 by connecting the pair of the first column plates 231 to improve the strength of the first H beams 230. For example, each of the horizontal reinforcement connectors 233 may be implemented in various forms, or may be realized as a plate-like reinforced steel plate or a structure with one side opened form. The horizontal reinforcement connectors 233 may be coupled to the inner face of the pair of first column plates 231 by using one or more of reinforcing bars and stud bolts or by welding.

FIG. 13A is a schematic view of a casing assembly guide for guiding a casing assembly for forming a CIP retaining wall according to an embodiment of the present invention. FIG. 13B is a schematic view of a CIP retaining wall fabricated using the casing assembly to form a CIP retaining wall, in accordance with an embodiment of the present invention, with FIG. 13*b*.

Referring to FIG. 13A and FIG. 13B, the casing assembly for forming the CIP retaining wall according to this embodiment is guided by a casing guide 20. In this way, an array of continuously generated CIP type retaining walls may be formed. The casing guide 20 for guiding a cylindrical casing used in forming a sheathing wall in a ground may comprise a first guide-body 21 having first inner and outer vertical faces and first top and bottom horizontal faces extending in a length-direction thereof, wherein the first inner face is configured in a shape thereof such that a plurality of first concave-rounded vertically-extended portions 23 are arranged in the length-direction and are connected to one another; a second guide-body 21 having second inner and outer vertical faces and top and bottom horizontal faces extending in a length-direction thereof, wherein the second inner face is configured in a shape thereof such that a plurality of second concave-rounded vertically-extended portions 23 are arranged in the length-direction and are connected to one another, wherein the second inner face faces away the first inner face; at least one first coupling unit (not shown) configured to couple the first and second guide-bodies to each other at the first and second top faces thereof; and at least one second coupling unit (not shown) configured to couple the first and second guide-bodies to each other at lower positions of the first and second inner faces thereof. The plurality of first concave-rounded vertically-extended portions and the plurality of second concave-rounded vertically-extended portions may define a plurality of casing accommodation spaces 23.

The first and second casing guide bodies 21 and 22 are mounted on the ground. Then, the casing assembly 100 is inserted into the casing accommodation space 23 defined by the first and second casing guide bodies 21 and 22. Thereafter, a concrete is injected into the casing assembly 110 to form the CIP retaining wall to formed of a concrete c surrounding the first H beam 130.

For example, the hollow elongate cylinder 110 is inserted between the first and second casing guide bodies 21, 22. The H-beam guide 120 is inserted into the hollow elongate cylinder 110. The fastening flange 123 is used to achieve the fastening between the H-beam guide 120 and the hollow elongate cylinder 110. In this connection, the hollow elongate cylinder 110 is accommodated within the casing accommodation space 23 defined by the first and second casing guide bodies 21, 22. The plurality of such accommodation spaces 23 may be arranged in a row so that the plurality of hollow elongate cylinders 110 may be accommodated in these accommodation spaces 23 respectively.

Then, the first H beam 130 is inserted into the H-beam guide 120. The H-beam guide 120 is withdrawn and removed. Concrete is poured into the hollow elongate cylinder 110. After separating and removing the hollow elongate cylinder 110, a concrete-based CIP retaining wall 10 having the first H beam 130 embedded therein may be formed.

FIGS. 14A to 14D are a top view and a side view of the first H beam, a reinforcing member thereof, and a CIP retaining wall formed using the first H beam according to an embodiment of the present invention, respectively. FIG. 14A is a top view of the first H beam according to an embodiment of the present invention. FIG. 14B is a side view of the first H beam of FIG. 14A. FIG. 14C is a perspective view showing horizontal reinforcement connectors constituting the first H beam of FIG. 14A. FIG. 14D is a schematic view of CIP retaining walls formed continuously using the first H beam of FIG. 14A.

FIGS. 15A to 15D are a top view and a side view of the first H beam, a reinforcing member thereof, and a CIP retaining wall formed using the first H beam according to another embodiment of the present invention, respectively. FIG. 15A is a top view of the first H beam according to an embodiment of the present invention. FIG. 15B is a side view of the first H beam of FIG. 15A. FIG. 15C is a perspective view showing horizontal reinforcement connectors constituting the first H beam of FIG. 15A. FIG. 15D is a schematic view of CIP retaining walls formed continuously using the first H beam of FIG. 15A.

FIGS. 16A to 16D are a top view and a side view of the first H beam, a reinforcing member thereof, and a CIP retaining wall formed using the first H beam according to still another embodiment of the present invention, respectively. FIG. 16A is a top view of the first H beam according to an embodiment of the present invention. FIG. 16B is a side view of the first H beam of FIG. 16A. FIG. 16C is a perspective view showing horizontal reinforcement connectors constituting the first H beam of FIG. 16A. FIG. 16D is a schematic view of CIP retaining walls formed continuously using the first H beam of FIG. 16A.

Referring to FIG. 14A to FIG. 14D, the first H beam 130 may be shown as in FIG. 1. The first H beam 130 includes a pair of first column plates 131 facing each other and spaced from each other and parallel to each other, a first column bridge 132 connecting the pair of first column plates 131 at centers thereof, and horizontal reinforcement connectors 133 spaced from the first column bridge 132, each connector connecting the distal ends of the pair of the first column plates 131. The first column plates 131 may be supported by the first column bridge 132 coupled thereto. The horizontal reinforcement connectors 133 reinforce the pair of the first column plates 131 by connecting the pair of the first column plates 131 to improve the strength of the first H beams 130. For example, each of the horizontal reinforcement connectors 133 may be implemented in various forms, or may be realized as a plate-like reinforced steel plate or a structure with one side opened form. The horizontal reinforcement connectors 133 may be coupled to the inner face of the pair of first column plates 131 by using one or more of reinforcing bars and stud bolts or by welding.

Referring to FIG. 15A to FIG. 15D, a first H beam 130*a* includes a pair of first column plates 131 facing each other and spaced from each other and parallel to each other, a first column bridge 132 connecting the pair of first column plates 131 at centers thereof, and horizontal reinforcement connectors 134 spaced from the first column bridge 132, each connector 134 connecting the distal ends of the pair of the first column plates 131. The first column plates 131 may be supported by the first column bridge 132 coupled thereto. The horizontal reinforcement connectors 134 reinforce the pair of the first column plates 131 by connecting the pair of the first column plates 131 to improve the strength of the first H beams 130.

Each of the horizontal reinforcement connectors 134 includes an elongate extension 134*a* extending parallel to and spaced apart from the first column bridge 132 and bent portions 134*b* extending from both ends of the elongate extension 134*a* and extending parallel to and being in contact with the inner faces of the pair of the first column plates 131 respectively. Accordingly, each of the horizontal reinforcement connectors 134 may be formed in a U-shape, strictly, go degree-turned U shape. Each of the horizontal reinforcement connectors 134 may be made of a U-shaped bent steel bar. The open side of the U-shaped steel bar may face the first column bridge 132. Such a U-shaped steel bar may be formed at left and right sides of the first column bridge 132. This U-shaped steel bar 134 is shown in FIG. 15C. Each of the horizontal reinforcement connectors 134 has the bent portions 134*b* bent from the elongate extension 134*a* and being in contact with the pair of first column plates 131 and connected thereto. By using such reinforcing bars, more stable reinforcement is achieved.

Referring to FIG. 16A to FIG. 16D, a first H beam 130*b* includes a pair of first column plates 131 facing each other and spaced from each other and parallel to each other, a first column bridge 132 connecting the pair of first column plates 131 at centers thereof, and horizontal reinforcement connectors 135 spaced from the first column bridge 132, each connector 135 connecting the distal ends of the pair of the first column plates 131. The first column plates 131 may be supported by the first column bridge 132 coupled thereto. The horizontal reinforcement connectors 135 reinforce the pair of the first column plates 131 by connecting the pair of the first column plates 131 to improve the strength of the first H beams 130.

Referring to FIG. 16A to FIG. 16D, each of the horizontal reinforcement connectors 135 may be implemented in the form of a stud bolt. Each of the horizontal reinforcement connectors 135 may include both head portions 135*a* and a body portion 135*b*. The head portion 135*a* may have a larger cross-sectional area than the body portion 135*b*. Each of the horizontal reinforcement connectors 135 may be oriented parallel to the first column plate 131. The body portion 135*b* may extend through the first column bridge 132. Two horizontal reinforcement connectors 135 may be arranged along the first bridge 132 to be spaced from each other. Each horizontal reinforcement connector 135 extends in an orthogonal manner to the first bridge 132. This can reinforce the strength of the first H beam 130*b*. Further, this increases the contact area between the first H beam 130*b* and the concrete, thereby further improving the strength of the finally formed CIP retaining wall.

FIG. 17A is a schematic view of a CIP retaining wall manufactured using a casing assembly to form a CIP retaining wall, according to another embodiment of the present invention.

FIG. 17B is a view schematically showing CIP retaining walls formed continuously in connection with FIG. 17A. FIGS. 18 to 24 are schematic illustrations of securing successive CIP retaining walls to an outer retaining wall using steel bars to form an underground retaining wall with beams and slabs.

Referring to FIG. 17A and FIG. 17B, the casing assembly for forming the CIP retaining wall according to the present embodiment may further include a second H beam 330 installed on a side face of the CIP retaining wall 11. The second H beam 330 may include at least one second H beam 330 connected to a side face of the first H beam 130. The second H beam 330 includes a pair of second column plates 331 facing each other and spaced apart from each other; a second horizontal bridge 332 connecting the inner faces of the pair of second column plates 331 with each other and extending perpendicularly to the second column plates 331; and one or more stud bolts 333 disposed on the outer face of each of the second column plates 331.

The casing assembly for forming the CIP retaining wall according to the present embodiment includes the first H beam 130 embedded in the concrete pile c having a shape fixed by the hollow elongate cylinder 110 and having a substantially cylindrical shape. The second H beam 330 may be coupled to a side face of the first H beam 130. The first H beam 130 may reinforce the strength of the CIP retaining wall. The stud bolts 333 provided on the second H beam 330 serves as a steel bar. The second column plates 331 of the second H beam 330 may be partially inserted into the hollow elongate cylinder as shown in FIG. 17A. By placing the concrete between the H beam guide and the inner surface of the hollow elongate cylinder, the second column plates 331 of the second H beam 330 are coupled to the first column plates of the first H beam 130. Thereby, the CIP retaining wall 11 and the stud bolt 333 may be connected to each other. Through the stud bolt 333, the CIP retaining wall 11 may be combined with the underground outer retaining wall.

By providing the second H beam 330, the CIP retaining wall can be firmly fixed to the underground outer retaining wall. Further, since the one or more stud bolts 333 provided in the second H beam 330 serve as steel bars, it is possible to easily improve the reinforcement, thereby making the sheathing wall construction easier.

Referring to FIG. 18 to FIG. 24, by using the casing guide comprising the first and second casing guide bodies (see FIG. 13A), the CIP retaining wall 11 manufactured using the casing assembly for forming the CIP retaining wall according to the present invention may be continuously arranged in a serial manner as shown in FIG. 18. Thus, an array 1000 of CIP type retaining walls may be formed. Steel bars 51 and 52 may be connected to the stud bolts 333 on the second H beam 330 protruding outwardly. Thus, Beams and slabs may be connected to these steel bars which may be secured to the outer retaining wall 50. As a result, the underground outer retaining wall complex may be formed.

The position and size of the second H beam 330, the connection configuration of the steel bars 51 and 52, the configuration of the beam and the slab may be variously changed. Thus, the CIP retaining wall 11 according to the present embodiment may be fixed to the outer retaining wall 50 having a variety of thicknesses and locations. Thus, various types of underground retaining wall complexes may be achieved.

FIG. 25 is a view showing a first H beam according to another embodiment of the present invention. FIG. 26 is a view showing a connection structure of a first H beam and a second H beam in FIG. 25. FIG. 27 illustrates a CIP retaining wall having first and second H beams according to an embodiment of the present invention. FIG. 28 is a view showing a state in which an underground retaining outer retaining wall is formed by connecting CIP retaining walls in conjunction with FIG. 27.

Referring to FIG. 25 to FIG. 28, the casing assembly for forming the CIP retaining wall according to the present embodiment may further include a reinforcing column plate 460 between the first and second H beams 430 and 470. The first H beam 430 may be coupled to the second H beam 470 by bolts 450 inserted into one or more bolt holes 434. To this end, the bolt holes 434 may pass through each of the pair of first column plates 431, which extend perpendicularly to the first column bridge 432.

The first H beam 430 is received within the hollow elongate cylinder 110. Before pouring concrete into the hollow elongate cylinder 110, one or more bolt holes 434 are defined in the first column plate 431 of the first H beam 430, for engagement with the second H beam 370. A provisional spacer member 435 made of styrofoam or plastic may be provided between the outer surface of the first column plate 431 and the second H beam 370. The bolt holes 434 may also be defined in the provisional spacer member 435.

In this way, the provisional spacer member 435, made of, for example, styrofoam or plastic, is disposed on the outer surface of the first H beam 430. In this state, concrete is poured into the hollow elongate cylinder. The concrete in the side portion of the first column plate 431 adjacent to the bolt holes 434 and the spacer member 435 is crushed-removed away. Thus, a side portion of the first H beam 430 can be exposed. Concrete is not formed in a region corresponding to the provisional spacer member 435 made of the styrofoam or plastic. Thereby, after the concrete is poured, the provisional spacer member 435 is removed, thereby defining the empty space corresponding to the provisional spacer member 435. The reinforcing column plate 460 may be inserted into the empty space. In this connection, the bolt holes may also be defined in the reinforcing column plate 460. The reinforcing column plate 460 reinforces the fastening between the first H beam 430 and the second H beam 470. The first H beam 430 and the second H beam 470 can be securely fastened to each other by inserting and fastening the bolts 450 into the bolt holes respectively.

In the following, referring to FIG. 29 and FIG. 32, another embodiment of the present invention will be described. Except for as described below, descriptions similar to those described in the previous embodiments as described in FIG. 1 to FIG. 18 are omitted for clarity of the present disclosure.

FIG. 29 is a flowchart illustrating an underground outer retaining wall construction method based on a CIP method according to a preferred embodiment of the present invention. FIG. 30 to FIG. 32 are schematic top views of an underground outer retaining wall formed by the construction method according to FIG. 29.

Referring to FIG. 29 to FIG. 32, the underground outer retaining wall construction method using the CIP method according to the present embodiment may involve using the casing assembly to form an underground outer retaining wall using the CIP method to form the CIP retaining wall, as described above.

The method may include placing a first guide-body 21 having first inner and outer vertical faces and first top and bottom horizontal faces extending in a length-direction thereof, wherein the first inner face is configured such that a plurality of first concave-rounded vertically-extended portions are arranged in a shape thereof the length-direction and are connected to one another; placing a second guide-body 21 having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face; and securing the first and second guide-bodies to each other.

The method further include inserting a hollow elongate cylinder between and into the first and second inner faces of the first and second guide-bodies; inserting an H-beam guide into the hollow elongate cylinder; and inserting the first H beam into the H-beam guide.

Further, the underground outer retaining wall construction method according to the present embodiment may further include the following steps: drawing the H-beam guide out of the hollow elongate cylinder; pouring concrete into the hollow elongate cylinder; removing the H-beam guide; and forming a CIP retaining wall.

After forming the CIP retaining wall, the method further comprises installing a second H beam having stud bolts onto a side portion of the first H beam. In this connection, the step of installing the second H beam comprises steps of crushing and removing concrete from a side portion of the CIP retaining wall, and exposing the side portion of the first H beam, and welding or bolting the second H beam to the side portion of the first H beam.

After the step of installing the second H beam, the method includes placing steel bars in the second H beam may include placing and arranging steel bars to the second H beam, additionally pouring concrete to integrate the CIP retaining wall, the stud bolts of the second H beam, and the steel bars with the concrete, thereby to form the underground outer retaining wall.

The first H beam can improve the internal strength of the CIP retaining wall. The second H beam couples the CIP retaining wall through the steel bars to the beams and the slabs. This allows the CIP wall to couple with the outer retaining wall, thereby forming the stronger underground outer retaining wall.

Referring to FIG. 30, in the step of inserting the hollow elongate cylinder in the space defined by the pair of casing guide bodies, adjacent hollow elongate cylinders may be inserted to be spaced apart from each other. A CIP retaining wall having the first H beam 130 embedded therein may be formed in an area corresponding to the hollow elongate cylinder, while, a retaining wall having only the concrete c and not having the first H beam 130 may be formed in an area not corresponding to the hollow elongate cylinder. In successive CIP retaining walls thus formed, the first H beams are aligned to be spaced from each other. The second H beam 330 connected to the side portion of the first H beam 130 where the concrete is removed away and is exposed may be connected to the steel bars 51 and 52 through one or more stud bolts provided on the second H beam 330. A beam is formed in the region corresponding to the linear steel bar, and a slab is connected to the beam. Thereby, the CIP wall may be easily fixed to the outer retaining wall 50. Thereby, the final underground retaining wall complex 1000*a* may be achieved.

Referring to FIG. 31, in inserting the first H beam 130 into the H-beam guide, the first H beam includes a pair of first column plates facing each other and spaced from each other and parallel to each other, a first column bridge connecting the pair of first column plates at centers thereof, and horizontal reinforcement connectors spaced from the first column bridge, each connector connecting the distal ends of the pair of the first column plates.

The first H beams 130 may be classified as the first H beams, each having the first length of the first column plate and auxiliary H beams 130', wherein the auxiliary H beam has the first column plate having a length less than the first length. The first H beam 130 is inserted into the hollow elongate cylinder. The auxiliary H beam 130' may be disposed between neighboring first H beams 130.

When the auxiliary H beam 130' is provided, the first H beam 130 is position-guided by the hollow elongate cylinder and an H-beam guide, while in a narrow space between the first H beams 130 arranged apart from each other, the auxiliary H beam 130' having a narrower width than that of the first H beam 130 may be disposed. The first H beams 130 and the auxiliary H beams 130' which are alternately arranged with each other, can further enhance the strength of an array of the continuously arranged CIP retaining walls. The second H beam 330 is connected to the side face of the first H beam 130. Steel bars 51, 52 are connected to the second H beam. The connected steel bars 51, 52 are connected to beams and slabs. Thus, the CIP wall is connected to the outer retaining wall 50, thereby forming the underground retaining wall complex 1000*a*.

Referring to FIG. 32, the second H beam 330*a* comprises a pair of the second column plates facing each other and extending parallel to each other and spaced from each other, a second horizontal bridge extending between the inner surfaces of the pair of second column plates and extending perpendicular to the inner surfaces horizontally, and one or more stud bolts provided on an outer surface of the second column plate. Each of the second column plates of the second H beam 330*a* may be positioned to correspond to the position of the horizontal reinforcement connector. Alternatively, each of the second column plates of the second H beam 330*a* may be positioned further inwardly than the position of the horizontal reinforcement connector. In the latter case, the width of the second H beam 330*a* is narrower than the width of the first H beam 130. This allows for more flexible connections using steel bars.

Further, according to an embodiment of the present invention, the first and second H beams may be connected by welding. Alternatively, the first and second H beams may be fixed and connected by the bolts.

The first H beam may further include one or more bolt holes at a portion thereof where the second H beam is connected thereto, and one or more provisional spacer member on a portion thereof where the bolt holes are provided. The provisional spacer member may be made of styrofoam or plastic.

The first H beam with the provisional spacer member is inserted into the hollow elongate cylinder. After placing the concrete in the elongate cylinder, the hollow elongate cylinder may be removed and, thus, a CIP retaining wall may be formed. After the hollow elongate cylinder is removed, the concrete may be removed from the portion of the CIP wall where the bolt holes are provided in the first H beam and at the portion of the CIP wall where the second H beam is connected to the first H beam. The concrete is removed such that the provisional spacer member provided adjacent to the bolt holes, and the bolt holes in the first H beam may be exposed.

In another embodiment of the present invention, the provisional spacer member is removed from the first H beam, and, then, a reinforcing column plate is interposed between the first and second H beams. The bolts are inserted into the bolt holes to fix the second H beam. Thereby, the fixing between the first and the second H beams may be made more robust.

It will be understood by those skilled in the art that the present disclosure may be embodied in other specific forms without departing from the spirit or essential characteristics thereof. Therefore, it is to be understood that the above-described embodiments are illustrative in all aspects and not restrictive. The scope of the present invention is defined by the following claims rather than the above detailed description. All changes or modifications that come within the spirit and scope of the claims, and the equivalents thereof are to be construed as being included within the scope of the present invention.

What is claimed is:

1. A casing assembly for forming a cast-in-place pile (CIP) retaining wall based on a CIP method, the assembly comprising:

a hollow elongate cylinder having a hollow cylindrical inner space defined therein;

a H-beam guide received within the hollow cylindrical inner space of the hollow elongate cylinder; and a first H beam having a vertical column form and inserted into the H-beam guide, wherein the H-beam guide includes:

a hollow beam-guide frame having a rectangular cross-section such that the first H beam is insertably guided in and along the hollow beam-guide frame; and an outer rounded frame coupled to an outer face of the hollow beam-guide frame, wherein an outer face of the outer rounded frame conforms to an inner face of the hollow elongate cylinder, wherein a top portion of the outer rounded frame is fixed to a top portion of the hollow elongate cylinder via a fastening flange.

2. The casing assembly of claim 1, wherein the fastening flange includes:

a vertical portion formed in a shape rounded to conform to an outer face of the hollow elongate cylinder; and a horizontal portion extending perpendicularly to the vertical portion from a top of the vertical portion and contacting a top portion of the hollow elongate cylinder, wherein the horizontal portion is integral with a top portion of the H-beam guide, wherein fixing holes horizontally penetrate the vertical portion, wherein fasteners pass through the fixing holes, thereby to fix the vertical portion to the hollow elongate cylinder.

3. The casing assembly of claim 1, wherein the hollow beam-guide frame has one or more first lateral openings defined therein, wherein the first lateral openings are spaced apart from each other in a longitudinal direction of the hollow beam-guide frame, wherein the outer rounded frame has one or more second lateral openings defined therein, wherein the second lateral openings are spaced apart from each other in a longitudinal direction of the outer rounded frame, wherein the first lateral openings are arranged to be alternated with the second lateral openings.

4. The casing assembly of claim 1, wherein the first H beam includes:

a pair of first column plates facing each other and spaced from each other and extending parallel to each other;

a first column bridge connecting the pair of first column plates at centers thereof, wherein the bridge extends perpendicularly to the pair of first column plates; and horizontal reinforcement connectors spaced from the first column bridge, each reinforcement connector connecting distal ends of the pair of the first column plates.

5. The casing assembly of claim 4, further including a second H beam installed on a side face of the first H beam, wherein the second H beam includes:

a pair of second column plates facing each other and spaced apart from each other and extending parallel to each other;

a second horizontal bridge connecting inner faces of the pair of the second column plates with each other and extending perpendicularly to the second column plates; and one or more stud bolts disposed on an outer face of each of the second column plates.

6. The casing assembly of claim 1, wherein the hollow beam-guide frame includes:

a pair of main plates facing each other and spaced from each other and extending parallel to each other; and a pair of connection plates perpendicularly connected to inner faces of the pair of the main plates and spaced apart from each other in parallel, wherein both ends of each of the main plates extends outward beyond each of the connection plates and are connected to ends of a pair of the outer rounded frames respectively.

7. The casing assembly of claim 1, wherein the H-beam guide includes:

the hollow beam-guide frame having a rectangular hexahedral shape defining a space therein for accommodating the first H beams;

the outer rounded frame formed to surround an outer face of the hollow beam-guide frame and having a cylindrical shape having a hollow portion therein; and reinforcement ribs, each rib connecting an outer face of the hollow beam-guide frame and an inner face of the outer rounded frame.

8. The casing assembly of claim 7, wherein the hollow beam-guide frame has one or more first lateral openings defined therein, wherein the first lateral openings are spaced apart from each other in a longitudinal direction of the hollow beam-guide frame, wherein the outer rounded frame includes a plurality of outer rounded sub-frames spaced apart from one another vertically, wherein an uppermost outer rounded sub-frame is coupled to the fastening flange, wherein the plurality of outer rounded sub-frames define second lateral openings between adjacent outer rounded sub-frames.

9. The casing assembly of claim 8, wherein the fastening flange includes:

a donut-shaped horizontal portion extending perpendicularly to the uppermost outer rounded sub-frame and being in contact with a top portion of the hollow elongate cylinder; and a vertical portion extending vertically downwardly from the horizontal portion, wherein the horizontal portion is integrally coupled to the top portion of the hollow beam-guide frame, wherein fixing holes horizontally penetrate the vertical portion, wherein fasteners pass through the fixing holes, thereby to fix the vertical portion to the hollow elongate cylinder.

10. The casing assembly of claim 4, wherein each of the horizontal reinforcement connectors includes:

an elongate extension extending parallel to and spaced apart from the first column bridge; and bent portions bent perpendicularly from both ends of the elongate extension and extending parallel to and being in contact with inner faces of the pair of the first column plates respectively.

11. A method for a retaining wall complex using a casing assembly guide for guiding the casing assembly of claim 1, wherein the retaining wall complex includes a CIP retaining wall fabricated using the casing assembly of claim 1, wherein the method comprises:

providing the casing assembly guide, wherein the casing guide comprises:

a first guide-body having first inner and outer vertical faces and first top and bottom horizontal faces extending in a length-direction thereof, wherein the first inner face is configured in a shape thereof such that a plurality of first concave-rounded vertically-extended portions are arranged in the length-direction and are connected to one another; and a second guide-body having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face to define a casing accommodation space therebetween; and inserting the casing assembly into the casing accommodation space, wherein inserting the casing assembly into the casing accommodation space includes:

inserting the hollow elongate cylinder into the casing accommodation space;

inserting the H-beam guide into the hollow elongate cylinder;

fixing the H-beam guide to the hollow elongate cylinder via the fastening flange; and inserting the first H beam into the H-beam guide.

12. The method of claim 11, further comprising:

after inserting the first H beam into the H-beam guide, pulling upwardly the H-beam guide out of the cylinder; injecting concrete into the hollow elongate cylinder; and removing the hollow elongate cylinder from the concrete, thereby forming a CIP retaining wall.

13. The method of claim 12, further comprising:

after forming the CIP retaining wall, removing a side portion of the CIP retaining wall to expose a side portion of the first H beam; and coupling a second H beam to the exposed side portion of the first H beam via welding or fasteners, wherein the second H beam includes stud blots.

14. The method of claim 11, wherein inserting the casing assembly into the casing accommodation space includes: inserting a plurality of casing assemblies to be spaced from each other, wherein CIP retaining walls having the first H beam embedded therein are alternated with retaining walls free of the first H beam.

15. The method of claim 11, further comprising providing the first H beam, wherein the first H beam includes:

a pair of first column plates facing each other and spaced from each other and parallel to each other;

a first column bridge connecting the pair of first column plates at centers thereof; and horizontal reinforcement connectors spaced from the first column bridge, each connector connecting the distal ends of the pair of the first column plates, wherein providing the first H beam includes providing main first H beams, each min H beam having a first length of the first column plate, and auxiliary first H beams, wherein each auxiliary H beam has the first column plate having a length less than the first length, wherein inserting the first H beam into the H-beam guide includes: inserting the main first H beams into a plurality of first casing accommodation spaces receiving a plurality of hollow elongate cylinders respectively, wherein the method further comprises inserting auxiliary first H beams into a plurality of second casing accommodation spaces free of the hollow elongate cylinder, wherein the plurality of first casing accommodation spaces are alternated with the plurality of second casing accommodation spaces.

16. The method of claim 13, further comprising providing the second H beam, wherein the second H beam comprises:

a pair of the second column plates facing each other and extending parallel to each other and spaced from each other;

a second horizontal bridge extending between inner faces of the pair of second column plates and extending perpendicular to the inner faces; and one or more stud bolts provided on an outer surface of the second column plate, wherein coupling the second H beam to the exposed side portion of the first H beam includes coupling the second H beam to the exposed side portion of the first H beam such that each of the second column plates of the second H beam is positioned to correspond to a position of the horizontal reinforcement connector, or such that each of the second column plates of the second H beam is positioned further inwardly than the position of the horizontal reinforcement connector.

17. The method of claim 13, further comprising:

defining one or more bolt holes at a portion of the first H beam where the second H beam is connected thereto; and attaching one or more provisional spacer member to the first H beam to be adjacent to the bolt holes, wherein inserting the first H beam includes inserting the first H beam having the provisional spacer member attached thereto, wherein the method includes:

removing the provisional spacer member from the first H beam to define an empty space; and inserting a reinforcing plate into the empty space, wherein coupling the second H beam to the exposed side portion of the first H beam includes forming fixing bolt holes in the reinforcing plate and passing bolts through the bolt holes to fix the second beam to the first beam.

18. The method of claim 13, wherein the retaining wall complex includes an outer wall coupled to the CIP retaining wall, wherein the method further comprises:

connecting steel bars to the stud bolts of the second H beam; and additionally injecting concrete such that the steel bars, the CIP retaining wall and the stud bolts are integrated with each other via the additionally injected concrete to form the outer wall coupled to the CIP retaining wall.

* * * * *